United States Patent [19]

Ishigaki et al.

[11] Patent Number: 4,879,204

[45] Date of Patent: Nov. 7, 1989

[54] SILVER HALIDE PHOTOGRAPHIC ELEMENT CONTAINING A HYDRAZINE COMPOUND AND SPECIFIC DYES

[75] Inventors: Kunio Ishigaki; Toshiro Takahashi; Yuji Mihara; Keiichi Adachi; Shigeru Ohno; Masahiro Okada; Naomi Saeki, all of Kanagawa, Japan

[73] Assignee: Fuji Photo Film Co., Ltd., Kanagawa, Japan

[21] Appl. No.: 232,526

[22] Filed: Aug. 16, 1988

Related U.S. Application Data

[63] Continuation of Ser. No. 63,753, Jun. 22, 1987, abandoned, which is a continuation of Ser. No. 823,861, Jan. 29, 1986, abandoned.

[30] Foreign Application Priority Data

| | | | |
|---|---|---|---|
| Jan. 29, 1985 | [JP] | Japan | 60-14960 |
| Feb. 1, 1985 | [JP] | Japan | 60-18445 |
| Mar. 19, 1985 | [JP] | Japan | 60-54883 |
| Mar. 22, 1985 | [JP] | Japan | 60-57942 |
| Mar. 25, 1985 | [JP] | Japan | 60-60118 |

[51] Int. Cl.[4] ..... G03C 1/08

[52] U.S. Cl. ..... 430/512; 430/440; 430/448; 430/518; 430/523; 430/961

[58] Field of Search ..... 430/512, 518, 523, 961, 430/440, 448

[56] References Cited

U.S. PATENT DOCUMENTS

| | | | |
|---|---|---|---|
| 3,898,088 | 8/1975 | Cohen et al. | 430/518 |
| 3,933,500 | 1/1976 | Shiba et al. | 430/578 |
| 4,078,933 | 3/1978 | Sugiyama et al. | 430/518 |
| 4,224,401 | 9/1980 | Takata et al. | 430/437 |
| 4,268,605 | 5/1981 | Hara et al. | 430/518 |
| 4,268,622 | 5/1981 | Adachi et al. | 430/518 |
| 4,456,681 | 6/1984 | Kadowaka et al. | 430/512 |
| 4,508,818 | 4/1985 | Ogawa et al. | 430/523 |

*Primary Examiner*—Jack P. Brammer

*Attorney, Agent, or Firm*—Sughrue, Mion, Zinn, Macpeak & Seas

[57] ABSTRACT

A silver halide photographic material is described, comprising a support having formed thereon at least one silver halide emulsion layer and at least one light-insensitive hydrophilic colloid layer, wherein at least one of layers consisting of said at least one silver halide emulsion layer and said at least one light-insensitive hydrophilic colloid layer contains a hydrazine derivative, and wherein at least one of said at least one light-insensitive hydrophilic colloid layer that is formed on the uppermost silver halide emulsion layer contains a dye.

16 Claims, No Drawings

SILVER HALIDE PHOTOGRAPHIC ELEMENT CONTAINING A HYDRAZINE COMPOUND AND SPECIFIC DYES

This is a continuation of application Ser. No. 07/063,753 filed June 22, 1987, which is a continuation of application Ser. No. 06/823,861 filed Jan. 29, 1986.

FIELD OF THE INVENTION

This invention relates to silver halide photographic materials and, more particularly, to silver halide photographic materials capable of giving high contrast negative images suitable for photomechanical process.

BACKGROUND OF THE INVENTION

In a photomechanical process, a photographic images having a continuous tone are converted into so-called halftone dot images of the shade of the continuous tone images expressed by the sizes of varying halftone dot areas and an original for printing is made by combining the halftone dot images with another original having letter images and line images.

For reproducing good line images or halftone dot images, a photographic light-sensitive material, which is used for a photomechanical process is required to show so-called high contrast (in particular, of higher than 10 in gamma) photographic characteristics having a high image contrast and high blackened density clearly distinguishing image portions and non-image portions.

Hitherto, for the aforesaid purpose, a method of processing a so-called lithographic type silver halide light-sensitive material composed of silver chlorobromide containing less than 40 mol % silver bromide with a hydroquinone developer (lithographic developer) having a very low effective concentration (usually, lower than 0.1 mol/liter) of sulfite ion is generally employed. However, since in this method the concentration of sulfite ion in the developer is low, the developer is very unstable to air oxidation.

Accordingly, an image-forming system of developing the light-sensitive material with a processing solution having a good storage stability for eliminating the unstability of the image formation by the lithographic development to provide a high contrast photographic characteristic has been desired. A system of forming a negative image having a high contrast of over 10 in gamma by processing a surface latent image type silver halide photographic material containing a specific acylhydrazine compound with a developer of 10.5 to 12.3 pH containing a sulfite preservative of higher than 0.15 mol/liter and showing a good storage stability has been proposed, for example, in U.S. Pat. Nos. 4,166,742, 4,168,977, 4,221,857, 4,224,401, 4,243,739, 4,272,606, 4,311,781, etc. The new image forming system has a feature that silver iodobromide or silver chloroiodide having high sensitivity can be used while in a silver chloride or silver chlorobromide only can be used.

For a silver halide photographic material are frequently used water-soluble dyes for various purposes such as safe light adaptability, etc. In particular, for enabling the contact printing step in a photomechanical process under a bright safe light, it has been attempted to reduce the sensitivity of a silver halide emulsion by using an inorganic or organic desensitizer such as a rhodium salt, an iridium salt, pinakryptol yellow, phenosafranine, etc., and at the same time, to add a safe light dye to the silver halide emulsion. On the other hand, it has been found that the addition of such a dye to a silver halide emulsion sometimes loses the controllability of the letter line width and the tone controllability of the halftone dot images in the contact printing step in a photomechanical process (practically, a performance capable of increasing the width to some extent more than the letter line width of the original used and broadening to some extent the areas of the halftone dots more than those of the original halftone dots, a performance capable of making such a correction of the original in the case of giving an artisitic impression being required in addition to the performance capable of reproducing completely the same line width and dot area as those of the original in the contact printing step) and also as well as reduces the contrast increasingly effect by the aforesaid hydrazone derivative.

SUMMARY OF THE INVENTION

An object of this invention is to provide a silver halide photographic material using a dye for preventing the reduction of contrast by a hydrazine derivative.

Another object of this invention is to provide a silver halide photographic material which can be treated under a bright safety light (bright room) and can provide high contrast photographic characteristics by processing using a stable developer.

It has now been discovered that the aforesaid objects of this invention can be attained by a silver halide photographic material comprising a support having formed thereon at least one silver halide emulsion layer and at least one light-insensitive hydrophilic colloid layer, wherein at least one of layers consisting of said at least one silver halide emulsion layer and said at least one light-insensitive hydrophilic colloid layer contains a hydrazine derivative, and wherein at least one of said at least one light-insensitive hydrophilic colloid layer that is formed on the uppermost silver halide emulsion layer contains a dye.

DETAILED DESCRIPTION OF THE INVENTION

In this invention a light-insensitive hydrophilic colloid layer is formed on the upper portion of silver halide emulsion layer(s), that is, at the position farther from the support than the silver halide emulsion layer(s) and a dye is incorporated in the light-insensitive hydrophilic colloid layer (preferably, substantially in the light-insensitive hydrophilic colloid layer only).

The light-insensitive hydrophilic colloid layer containing a dye may be formed on the silver halide emulsion layer directly or through an interlayer. Furthermore, other light-insensitive hydrophilic colloid layer may be formed on the light-insensitive hydrophilic colloid layer containing a dye. It is preferred that at least one light-insensitive hydrophilic colloid layer dyed with a dye (hereinafter, is referred to as dyed layer) is formed on (i.e., at the position farther from the support than) the silver halide emulsion layer through at least one light-insensitive hydrophilic colloid layer (interlayer).

The above-described interlayer is composed of a hydrophilic colloid and has preferably a thickness of 0.1 micron to 5 microns. One interlayer is enough but two or more such interlayers may be employed. By the existence of the interlayer(s), the adhesion between the dyed layer and the silver halide emulsion layer is improved to prevent the emulsion layer(s) from peeling off and the formation of solid matters at the coating step can be prevented. Also, in the case of using a mordant, it is preferred to use an anionic surface active agent and an amphoteric surface active agent for facilitating coating and improving the mordanting property. These surfaces active agents may be added to any coating compositions for making a silver halide emulsion layer or other layers composing the silver halide photographic material of this invention but it is particularly preferred to add them to the light-insensitive hydrophilic colloid layer formed on the dyed layer.

When at least two light-insensitive hydrophilic colloid layers are formed on the uppermost silver halide emulsion layer, it is preferred that at least one of the at least two light-insensitive hydrophilic colloid layers other than an uppermost light-insensitive hydrophilic colloid layer contains a dye and the at least two light-insensitive hydrophilic colloid layers contains an anionic surface active agent and an amphoteric surface active agent.

As the dye for use in this invention, there are oxonol dyes, hemioxonol dyes, merocyanine dyes, cyanine dyes, azo dyes, etc., and in this case water-soluble dyes are advantageous from the viewpoint of reducing color stain after processing.

Practical examples of the dyes for use in this invention are pyrazoloneoxazole dyes described, for example, in U.S. Pat. No. 2,274,782; diarylazo dyes described, for example, in U.S. Pat. No. 2,956,879; styryl dyes and butadienyl dyes described, for example, in U.S. Pat. Nos. 3,423,207, 3,384,487, etc.; merocyanine dyes described, for example, in U.S. Pat. No. 2,527,583; merocyanine dyes and oxonol dyes described, for example, in U.S. Pat. Nos. 3,846,897, 3,652,284, 3,718,472, etc.; enaminohemioxonol dyes described, for example, in U.S. Pat. No. 3,976,661, and the dyes described, for example, in British Pat. Nos. 584,609, 1,177,429, Japanese Patent Application (OPI) Nos. 85130/73, 99620/74, 114420/74 (the term "OPI" as used herein refers to a "published unexamined Japanese patent application"), and U.S. Pat. No. 2,533,472, 3,148,187, 3,177,078, 3,247,127, 3,540,887, 3,575,704, 3,653,905, etc.

In the case of applying this invention for the purpose of imparting safe light property, a dye having the absorption characteristics that the absorption for the safe light wavelength region is larger than that for the light exposure wavelength region is used. The amount of the dye used is an amount capable of losing the light sensitivity of a silver halide emulsion for safe light and is usually $10^{-3}$ g/m$^2$ to 1 g/m$^2$, particularly $10^{-3}$ g/m$^2$ to 0.5 g/m$^2$.

In the case of using ultraviolet rays for light exposure of the photographic light-sensitive material and also using a white lamp equipped with a filter shielding ultraviolet rays as a safe light, it is preferred to use a dye capable of reducing the light sensitivity of silver halide emulsion for visible rays, or it is preferred to use a dye having $\lambda_{max}$ in the range of longer than 390 nm, more preferably 390 nm to 750 nm, most preferably 390 nm to 550 nm. Examples of these dyes are those represented by the following general formulae (a), (b), (c), (d), (e), and (f).

(a)

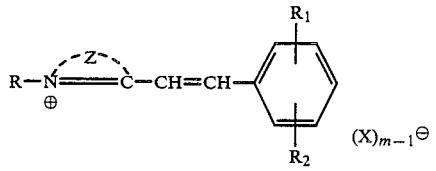

(b)

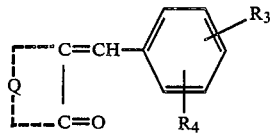

(c)

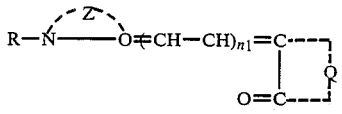

(d)

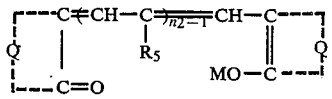

wherein Z represents a non-metallic atomic group necessary for forming heterocyclic nuclei of benzothiazole, naphthothiazole, or benzoxazole; Q represents an atomic group necessary for forming pyrazolone, barbituric acid, thiobarbituric acid, isoxazolone, 3-oxythionaphthene, or 1,3-indanedione; R represents a substituted or unsubstituted alkyl group; $R_1$, $R_2$, $R_3$ and $R_4$ each represents a hydrogen atom, an alkoxy group, a dialkylamino group or a sulfo group; $R_5$ represents a hydrogen atom or a halogen atom; M represents a hydrogen atom, a sodium atom, or a potassium atom; X represents an anion; m, $n_1$ and $n_2$ each represents 1 or 2; when m is 1, the dye forms an intramolecular salt.

(e)

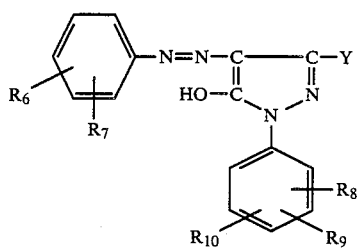

(f)

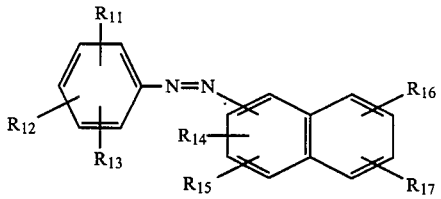

wherein Y represents an alkyl group or a carboxy group; $R_6$, $R_7$, $R_8$, $R_9$, $R_{10}$, $R_{11}$, $R_{12}$, $R_{13}$, $R_{14}$, $R_{15}$, $R_{16}$ and $R_{17}$ each represents a hydrogen atom, an alkyl group, a hydroxy group, an amino group, an acylamino group, a carboxy group or a sulfo group; said $R_{12}$ and $R_{13}$ may combine with each other to form a benzene ring.

In the dyes represented by the above-described general formulae (a) to (f), the dyes having an acid group such as a sulfo group, a carboxy group, etc., are preferred. Specific examples of the dyes are illustrated below.
F-1
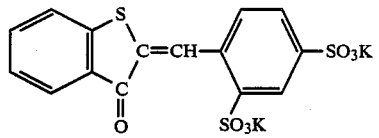
F-2
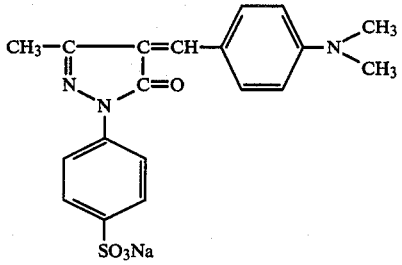
F-3
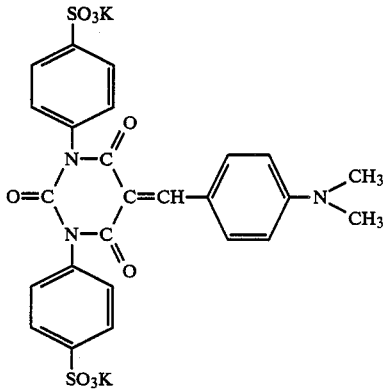
F-4
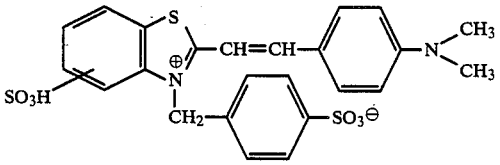
F-5
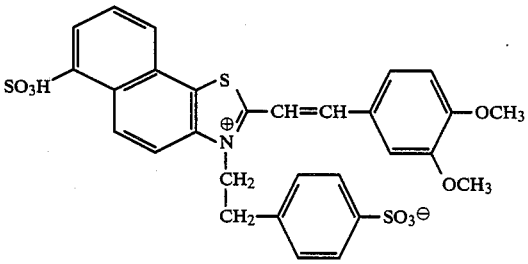
F-6
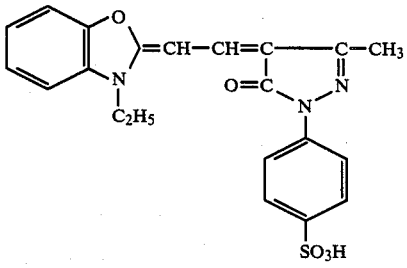
-continued
F-7
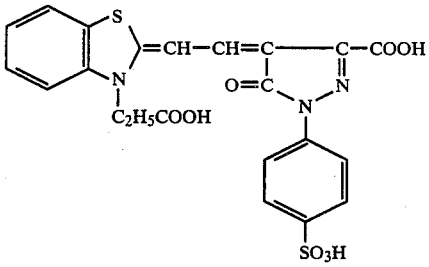
F-8
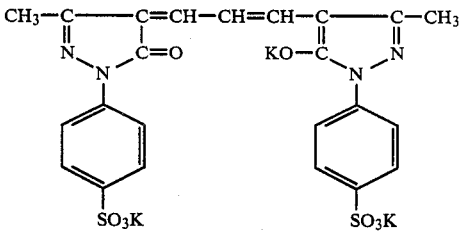
F-9
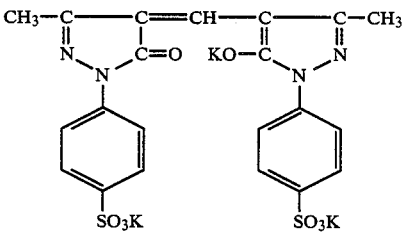
F-10
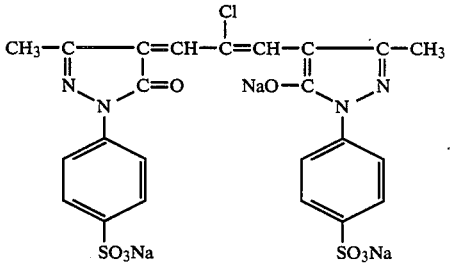
F-11
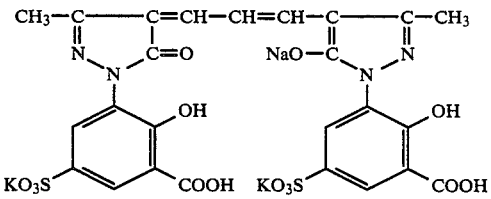
F-12
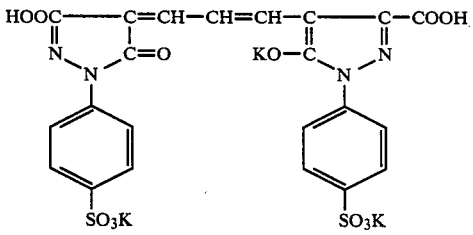

-continued

F-13

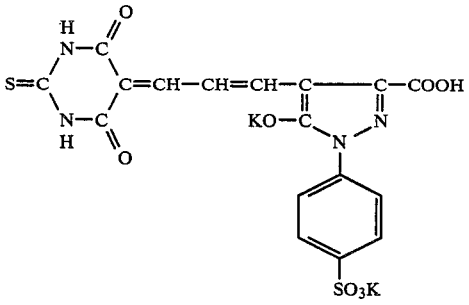

F-14

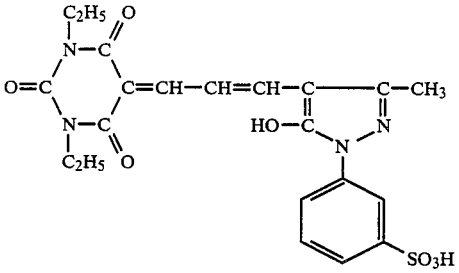

F-15

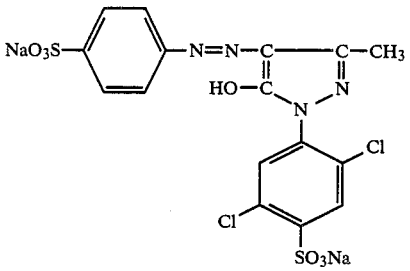

F-16

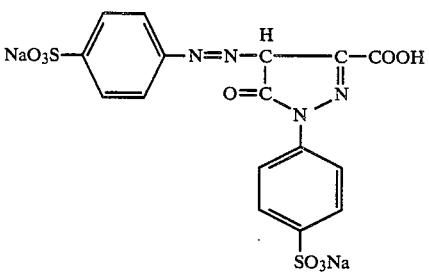

F-17

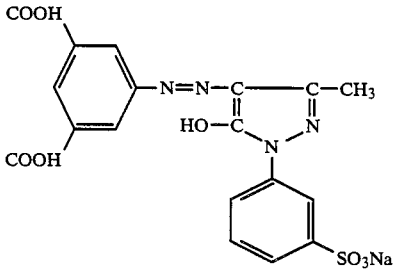

F-18

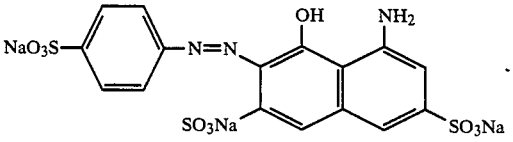

-continued

F-19

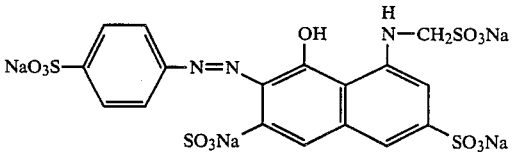

F-20

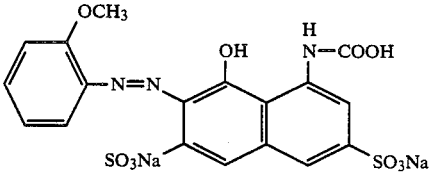

F-21

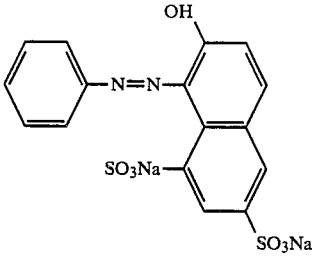

F-22

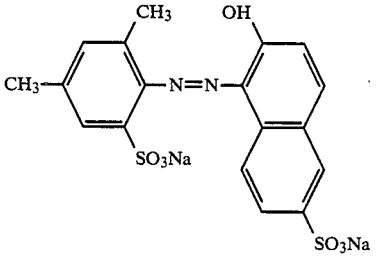

F-23

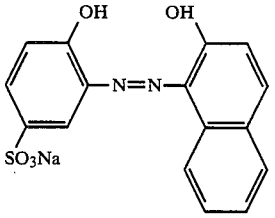

F-24

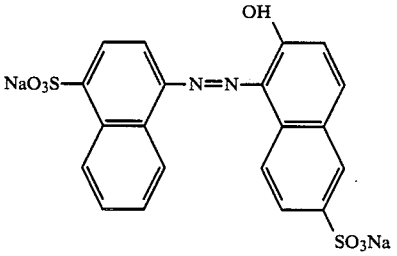

The dye described above is dissolved in a proper solvent such as water, an alcohol (e.g., methanol, ethanol, propanol, etc.), acetone, methyl cellosolve, etc., or a mixture thereof and added to a coating composition for the light-insensitive hydrophilic colloid layer of this invention. The dyes described above may be used solely or in a combination of them.

For incorporating the dye substantially in the light-insensitive hydrophilic colloid layer only in this invention, it may prevent the dye existing in the light-insensitive hydrophilic colloid layer from diffusing to silver halide emulsion layer(s). For example, a silver halide emulsion is coated on a support and after setting the emulsion layer thus formed, the light-insensitive hydrophilic colloid layer containing the nondiffusible dye may be coated on the silver halide emulsion layer. Also, in the case of simultaneously coating the silver halide emulsion layer and the light-insensitive layer by a multilayer simultaneous coating method, it is most preferred to add a polymer mordant to the coating composition for the light-insensitive hydrophilic colloid layer together with the diffusible dye or the dye described above.

As the polymer mordant for use in this invention, there are a polymer having a secondary or tertiary amino group, a polymer having a nitrogen-containing heterocyclic ring moiety, and a polymer having a quaternary cation group derived therefrom, each having a molecular weight of 5,000 to 200,000, preferably 10,000 to 50,000.

Examples of the polymer mordant are the vinylpyridine polymers and vinylpyridinium polymers disclosed in U.S. Pat. Nos. 2,548,564, 2,474,430, 3,148,061, 3,756,814, etc.; the polymer mordants capable of causing cross-linkage with gelatin, etc., disclosed in U.S. Pat. Nos. 3,625,694, 3,859,096, 4,128,538, British Pat. No. 1,277,453, etc.; the aqueous sol type mordants disclosed in U.S. Pat. Nos. 3,958,995, 2,721,852, 2,798,063, Japanese patent application (OPI) Nos. 115228/79, 145529/79, 126027/79, etc.; the water-insoluble mordants disclosed in U.S. Pat. No. 3,898,088; the reactive mordants capable of forming conjugated bond with a dye disclosed in U.S. Pat. No. 4,168,976 (corresponding to Japanese patent application (OPI) No. 137333/79); and further the mordants disclosed in U.S. Pat. Nos. 3,709,690, 3,788,855, 3,642,482, 3,488,706, 3,557,066, 3,271,147, 3,271,148, Japanese patent application (OPI) Nos. 71332/75, 30328/78, 155528/77, 125/78, 1024/78, etc.

Moreover, the mordants described in U.S. Pat. Nos. 2,675,316 and 2,882,156 can be also used in this invention.

In these mordants, the mordants which are reluctant to diffuse from the light-insensitive hydrophilic colloid layer into the silver halide emulsion layer are preferably used and examples of the preferred mordants are the mordants capable of causing a cross-linking reaction with a hydraulic colloid such as gelatin, the water-insoluble mordants, and the aqueous sol (or latex dispersion) type mordants.

Specific examples of the particularly preferred mordants are shown below.

(1) A polymer having a quaternary ammonium group and a group capable of having a conjugated bond with gelatin (e.g., an aldehyde group, a chloroalkanoyl group, a chloroalkyl group, a vinylsulfonyl group, a pyridiniumpropionyl group, a vinylcarbonyl group, an alkylsulfonoxy group, etc.).

A specific example of the polymer is the polymer having the following structure:

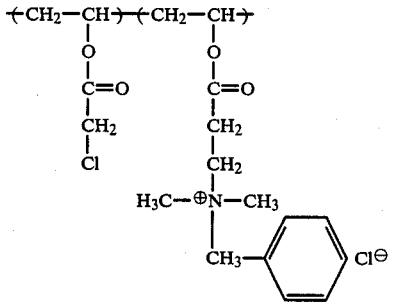

(2) A reaction product of a copolymer composed of a recurring unit of the monomer shown by the following general formula (I) and a recurring unit of other ethylenically unsaturated monomer and a cross-linking agent (e.g., bisalkane sulfonate, bisarylene sulfonate, etc.):

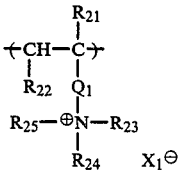

(I)

wherein $R_{21}$ represents a hydrogen atom or an alkyl group; $R_{22}$ represents a hydrogen atom, an alkyl group, or an aryl group; $Q_1$ represents a divalent group; $R_{23}$, $R_{24}$ and $R_{25}$ each represents an alkyl group, an aryl group, or a hydrogen atom; at least two of said $R_{23}$ to $R_{25}$ may combine with each other to form a heterocyclic ring; and $X_1$ represents an anion.

The above-described alkyl group and aryl group may be substituted.

(3) A polymer represented by general formula (II):

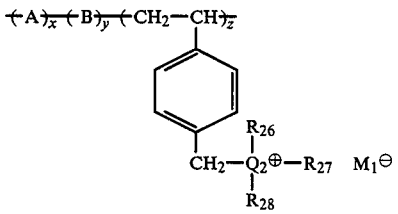

(II)

wherein x is about 0.25 mol to about 5 mol %, y is about 0 to about 90 mol %, z is about 10% to about 99 mol %, A represents a monomer having at least two ethylenically unsaturated bonds; B represents a copolymerizable ethylenically unsaturated monomer; $Q_2$ represents a nitrogen atom or a phosphorus atom; $R_{26}$, $R_{27}$ and $R_{28}$ each represent an alkyl group or a cyclic hydrocarbon group; at least two of said $R_{26}$ to $R_{28}$ may combine with each other to form a ring; and $M_1$ represents an anion.

The aforesaid groups and ring may be substituted.

(4) A copolymer composed of (a) a comonomer represented by general formula (III):

(III)

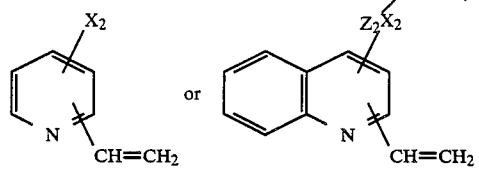

wherein $X_2$ represents a hydrogen atom, an alkyl group, or a halogen atom (the alkyl group may be substituted), (b) an acrylic acid ester, and (c) acrylonitrile.

(5) A water-insoluble polymer having a recurring unit represented by the following general formula (IV) in a proportion of more than $\frac{1}{3}$:

(IV)

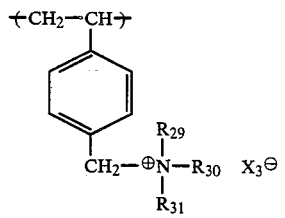

wherein $R_{29}$, $R_{30}$ and $R_{31}$ each represents an alkyl group; the total carbon atom numbers of said $R_{29}$ to $R_{31}$ being 12 or more; and X represents an anion.

The above-described alkyl group may be substituted.

In this invention, by using gelatin having an isoelectric point of higher than 5.5 for the dyecontaining light-insensitive hydrophilic colloid layer as the mordant, the dye can be fixed in the layer.

In this case, as gelatin having an isoelectric point of higher than 5.5, acid-processed gelatin is preferably used.

The production method for acid-processed gelatin is different from the production method of limeprocessed gelatin which is usually used in the field of photography.

Details of the production method, properties, etc., of acid-processed gelatin are described in Arthur Veis, *The Macromolecular Chemistry of Gelatin*, Academic Press, pages 186–192.

As gelatin having an isoelectric point of higher than 5.5 for use in this invention, gelatin having an isoelectric point of higher than 6.5, in particular, 7.0 to 9.5 is more particularly used.

In this invention the above-described gelatin having an isoelectric point of higher than 5.5 may be used for the light-insensitive hydrophilic colloid layer individually or together with gelatin having a lower isoelectric point or a polymer mordant.

As the nondiffusible dye for use in this invention, there are compounds shown by the following general formulae (V) and (VI)

(V)

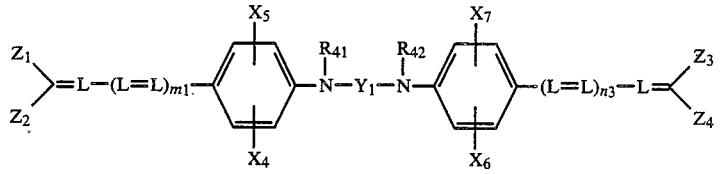

(VI)

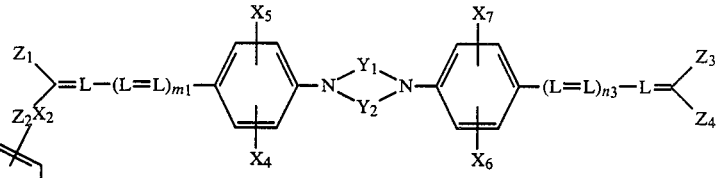

wherein $X_4$, $X_5$, $X_6$ and $X_7$, which may be the same or different, each represents a hydrogen atom, a halogen atom, an alkyl group having, preferably, 1 to 6 carbon atoms, and alkoxy group having, preferably, 1 to 6 carbon atoms, a hydroxy group, a carboxy group, a substituted amino group (e.g., an amino group substituted by an acyl group derived from an aliphatic carboxylic acid having, preferably, 1 to 6 carbon atoms or a sulfonic acid, an alkylamino group having, preferably, 1 to 6 carbon atoms, a dialkylamino group having, preferably, 1 to 6 carbon atoms, etc.), a carbamoyl group having, preferably, 2 to 7 carbon atoms, a sulfamoyl group having, preferably, 1 to 6 carbon atoms, or an alkoxycarbonyl group having, preferably, 2 to 6 carbon atoms;

$R_{41}$ and $R_{42}$, which may be the same or different, each represents a hydrogen atom, an unsubstituted or substituted alkyl group having 1 to 8 carbon atoms (examples of the substituent are a halogen atom, a hydroxy group, a cyano group, an alkoxy group, an acyl group, an acyloxy group, an acylamino group, a carbamoyl group, an alkylamino group, a dialkylamino group, a carboxy group, an alkoxycarbonyl group, a sulfonyl group, a sulfonylamino group, a sulfamoyl group, a sulfo group, an aryl group, etc.), an unsubstituted or substituted alkenyl group having, preferably, 2 to 6 carbon atoms, an unsubstituted or substituted aryl group [preferably, an unsubstituted or substituted phenyl group (examples of the substituent are a halogen atom, a cyano group, a sulfo group, a hydroxy group, a carboxy group, and alkoxy group, an alkyl group, a nitro group, etc.)], an acyl group having, preferably, 2 to 7 carbon atoms, an alkylsulfonyl group having, preferably, 1 to 6 carbon atoms, or an unsubstituted or substituted arylsulfonyl group [preferably, an unsubstituted or substituted phenyl group (examples of the substituent are a halogen atom, a cyano group, a sulfo group, a hydroxy group, an alkoxy group, an alkyl group, etc.)];

$Z_1$, $Z_2$, $Z_3$ and $Z_4$, which may be the same or different, each represents an electron attractive group such as an acyl group having, preferably, 2 to 13 carbon atoms, a carbamoyl group having, preferably, 2 to 13 carbon atoms, a carboxy group, an unsubstituted or substituted alkoxycarbonyl group having, preferably, 2 to 10 carbon atoms (examples of the substituent are a halogen atom, a hydroxy group, a cyano group, an alkoxy group, an acyl group, an acylamino group, an alkylamino group, a dialkylamino group, a carboxy group, an alkoxycarbonyl group, a sulfonyl group, a sulfonylamino group, a sulfo group, an aryl group, etc.), an unsubstituted or substituted aryloxycarbonyl group [examples of the substituent are a halogen atom, an alkyl group, an alkoxy group, a nitro group, a hydroxy group, a carboxy group, a cyano group, an unsubstituted or substituted amino group (examples of the substituent are an alkyl group, an acyl group, an alkylsulfonyl group, etc.), an alkoxycarbonyl group, etc.], a sulfonyl group having, preferably, 1 to 12 carbon atoms, a sulfamoyl group having, preferably, 1 to 12 carbon atoms, a cyano group, etc.; said $Z_1$ and $Z_2$ or said $Z_3$ and $Z_4$ may combine with each other to form a heterocyclic ring (e.g., a pyrazoline ring, a pyrazolotriazole ring, a pyrazoloimidazole ring, an oxyindole ring, an oxyimidazopyridine ring, an isoxazolone ring, a barbituric acid ring, a dioxytetrahydropyridine ring, an indandione ring, etc.);

$Y_1$ and $Y_2$ each represents a divalent linkage group such as an unsubstituted or substituted alkylene group having, preferably, 1 to 10 carbon atoms (examples of the substituent are halogen atoms, etc.), an unsubstituted or substituted arylene group [preferably, an unsubstituted or substituted phenylene group (examples of the substituent are a halogen atom, a hydroxy group, an alkoxy group, a carboxy group, an alkyl group, a nitro group, a sulfonylamino group, a sulfo group, etc.)], a carbonyl group, and an alkylene or arylene group having a functional group (e.g., an oxygen atom, a carbonyl group, a carbonyloxy group, a carbonate group, a carbonylamino group, a ureido group, an imido group, a sulfonylamino group, a sulfonylaminocarbonyl group, etc.);

L represents an unsubstituted or substituted methine group; and $m_1$ and $n_3$ represent 0 or 1.

More practically speaking, the above-described general formulae, $X_4$, $X_5$, $X_6$ and $X_7$, which may be the same or different, each represents a hydrogen atom, a halogen atom (e.g., a chlorine atom, a bromine atom, etc.), an alkyl group having 1 to 6 carbon atoms (e.g., methyl group, an ethyl group, a propyl group, a hexyl group, etc.), an alkoxy group having 1 to 6 carbon atoms (e.g., a methoxy group, an ethoxy group, a butoxy group, a hexyloxy group, etc.), a hydroxy group, a carboxy group, an amino group substituted by an acyl group derived from an aliphatic carboxylic acid having 1 to 6 carbon atoms or a sulfonic acid (e.g., an acetylamino group, a hexylcarbonylamino group, a methanesulfonylamino group, an ethanesulfonylamino group, a hexasulfonylamino group, a 3-sulfopropylcarbonylamino group, etc.), an alkylamino group having 1 to 6 carbon atoms (e.g., a methylamino group, an ethylamino group, a propylamino group, a hexylamino group, etc.), a dialkylamino group having 1 to 6 carbon atoms (e.g., a dimethylamino group, a diethylamino group, a dipropylamino group, etc.), a carbamoyl group having 2 to 7 carbon atoms (e.g., a methylcarbamoyl group, an ethylcarbamoyl group, etc.), a sulfamoyl group having 1 to 6 carbon atoms (e.g., a methylsulfamoyl group, an ethylsulfamoyl group, etc.), or an alkoxycarbonyl group having 2 to 6 carbon atoms (e.g., a methoxycarbonyl group, an ethoxycarbonyl group, a pentyloxycarbonyl group, etc.).

Also, $R_{41}$ and $R_{42}$, which may be the same or different, each represents a hydrogen atom, an unsubstituted or substituted alkyl group having 1 to 8 carbon atoms (e.g., a methyl group, an ethyl group, a propyl group, a butyl group, a pentyl group, a hexyl group, an octyl group, a 2-chloroethyl group, a 3-chloropropyl group, a 2-bromoethyl group, a 2-hydroxyethyl group, a cyanomethyl group, a 2-cyanoethyl group, a 3-cyanopropyl group, a 2-methoxyethyl group, a 3-methoxypropyl group, a 2-ethoxyethyl group, a 3-ethoxypentyl group, a 2-isopropoxyethyl group, an acetylmethyl group, a 2-acetylethyl group, a benzoylmethyl group, an acetyloxymethyl group, an ethylcarbonyloxymethyl group, a 2,2,2-trifluoroethylcarbonyloxymethyl group, an isopropylcarbonyloxymethyl group, a 2-(acetyloxy)ethyl group, a 2-(2,2,2-trifluoroethylcarbonyloxy) ethyl group, a 2-(isopropylcarbonyloxy) ethyl group, a benzyloxymethyl group, a 4-chlorobenzoyloxymethyl group, a 4-nitrobenzoyloxymethyl group, an acetylaminoethyl group, a 2-(ethylcarbonylamino) group, a methylcarbamoylmethyl group, a methylaminoethyl group, a 2-(ethylamino)ethyl group, a 2-(dimethylamino)ethyl group, a 2-(diethylamino)ethyl group, a carboxymethyl group, a 2-carboxyethyl group, a 3-carboxypropyl group, a 6-carboxyhexyl group, a methoxycarbonylmethyl group, an ethoxycarbonylmethyl group, a 2,2,2-trifluoroethoxycarbonylmethyl group, an isopropyloxycarbonylmethyl group, a 3-(isopropyloxycarbonyl) propyl group, a 2-(methoxycarbonyl)ethyl group, a 2-(ethoxycarbonyl)ethyl group, a 2-(2,2,2-trifluoroethoxycarbonyl) ethyl group, a methylsulfonylmethyl group, an ethylsulfonylmethyl group, a 2-(methylsulfonyl) ethyl group, a 2-(butylsulfonyl)ethyl group, a methylsulfonylaminomethyl group, a 2-(methylsulfonylamino) ethyl group, an ethylsulfonylaminomethyl group, a 3-(ethylsulfonylamino)-propyl group, a methylsulfamoylethyl group, a 2-sulfoethyl group, a 3-sulfopropyl group, a 4-sulfobutyl group, a 4-sulfophenylmethyl group, a phenylmethyl group, etc.), an alkenyl group having 2 to 6 carbon atoms (e.g., a 3-hexenyl group, etc.), an unsubstituted or substituted phenyl group (e.g., a phenyl group, a 4-chlorophenyl group, a 4-cyanophenyl group, a 4-sulfophenyl group, a 3-sulfophenyl group, a 4-hydroxyphenyl group, a 4-carboxyphenyl group, a 2-methoxyphenyl group, a 4-methoxyphenyl group, a 4-ethoxyphenyl group, a 4-methylphenyl group, a 4-nitrophenyl group, etc.), an acyl group having 2 to 7 carbon atoms (e.g., an acetyl group, a propionyl group, a heptanoyl group, a benzoyl group, etc.), an alkylsulfonyl group having 1 to 6 carbon atoms (e.g., a methylsulfonyl group, an ethylsulfonyl group, a hexylsulfonyl group, etc.), or an unsubstituted or substituted phenylsulfonyl group (e.g., a phenylsulfonyl group, a 4-chlorophenylsulfonyl group, a 4-cyanophenylsulfonyl group, a 4-sulfophenylsulfonyl group, a 2-hydroxyphenylsulfonyl group, a 4-hydroxyphenylsulfonyl group, a 4-methoxyphenylsulfonyl group, a 4-methylphenylsulfonyl group, etc.).

$Z_1$, $Z_2$, $Z_3$ and $Z_4$, which may be the same or different, each represents an electron attractive group such as an acyl group having 2 to 13 carbon atoms (e.g., an acetyl group, a propanoyl group, a hexanoyl group, a benzoyl group, a 4-aminobenzoyl group, a 4-nitrobenzoyl group, a 4-methylsulfonylaminobenzoyl group, a 4-ethylsulfonylaminobenzoyl group, a 4-propylsulfonylaminobenzoyl group, a 3-hydroxy-4-methylsulfonylaminobenzoyl group, etc.), a carbamoyl group having 2 to 13 carbon atoms (e.g., a methylcarbamoyl group, an ethylcarbamoyl group, a phenylcarbamoyl group, a 4-chlorophenylcarbamoyl group, a 4-nitro-phenylcarbamoyl group, a 4-methylsulfonylphenylcarbamoyl group, a 3-sulfophenylcarbamoyl group, a 4-propylsulfonylphenylcarbamoyl group, a 4-propylsulfonylphenylcarbamoyl group, a 4-methylsulfonylaminophenylcarbamoyl group, etc.), a carboxy group, an unsubstituted or substituted alkoxycarbonyl group having 2 to 10 carbon atoms (e.g., a methoxycarbonyl group, an ethoxycarbonyl group, a propoxycarbonyl group, an isopropoxycarbonyl group, a butoxycarbonyl group, a 1-methylpropoxycarbonyl group, a t-butylcarbonyl group, a chloroethoxycarbonyl group, a 2,2,2-trifluoroethoxycarbonyl group, a 3-(hydroxy-n-propoxy) carbonyl group, a cyanoethoxycarbonyl group, a methoxyethyloxycarbonyl group, an acetylethyloxycarbonyl group, an acetylaminoethyloxycarbonyl group, a methylaminoethyloxycarbonyl group, a dimethyloxyaminoethyloxycarbonyl group, a carboxyethyloxycarbonyl group, a methoxycarbonylethyloxycarbonyl group, a methylsulfonylethyloxycarbonyl group, a methylsulfonylaminoethyloxycarbonyl group, a sulfoethoxycarbonyl group, a phenylethoxycarbonyl group, etc.), an unsubstituted or substituted phenyloxycarbonyl group (e.g., a phenyloxycarbonyl group, a 4-chlorophenyloxycarbonyl group, a 4-methylphenyloxycarbonyl group, a 4-methoxyphenyloxycarbonyl group, a 4-nitrophenyloxycarbonyl group a 4-hydroxyphenyloxycarbonyl group, a 4-carboxyphenyloxycarbonyl group, a 4-cyanophenyloxycarbonyl group, a 4-dimethylaminophenyloxycarbonyl group, a 4-methoxycarbonyl group, a phenyloxycarbonyl group, etc.), a sulfonyl group having 1 to 12 carbon atoms (e.g., a methylsulfonyl group, an ethylsulfonyl group, a decylsulfonyl group, a phenylsulfonyl group, etc.), a sulfamoyl group having 1 to 12 carbon atoms (e.g., a methylsulfamoyl group, an ethylsulfamoyl group, a propylsulfamoyl group, a phenylsulfamoyl group, a 4-chlorophenylsulfamoyl group, etc.), a cyano group, etc. Also, said $Z_1$ and $Z_2$ or said $Z_3$ and $Z_4$ may combine with each other to form a heterocyclic ring (e.g., a pyrazolone ring, a pyrazolotriazole ring, a pyrazoloimidazole ring, an oxyindole ring, an oxyindazopyridine ring, an isooxazolone ring, a barbituric acid ring, a dioxytetrahydropyridine ring, an indandione ring, etc.).

$Y_1$ and $Y_2$ each is a divalent linkage group and represents an unsubstituted or substituted alkylene group having 1 to 10 carbon atoms (e.g., a methylene group, an ethylene group, a propylene group, a butylene group, a pentylene group, a hexelene group, a heptylene group, an octylene group, a xylylene group, a bromoethylene group, etc.), an unsubstituted or substituted arylene group (e.g., a phenylene group, a naphthylene group, a chlorophenylene group, a sulfophenylene group, a hydroxyphenylene group, a methoxyphenylene group, a carboxyphenylene group, a methylphenylene group, a nitrophenylene group, a methylsulfoaminophenylene group, etc.), a carbonyl group or an alkylene or arylene group having a functional group (e.g., an oxygen atom, a carbonate group, a carbonyl group, a carbonyloxy group, a ureido group, an imido group, a sulfonyl group, a sulfonylaminocarbonyl group, etc.); examples of the alkylene or arylene group are:

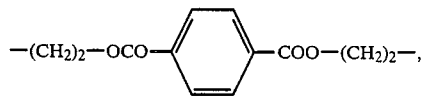

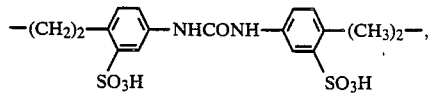

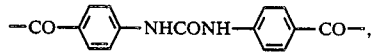

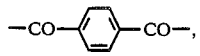

—CO—$(CH_2)_2$—CO—, etc.

L represents an unsubstituted or substituted methine group (examples of the substituent are a methyl group, etc.).

Also, $m_1$ and $n_3$ are 0 to 1.

The above-described compounds for use in this invention can be prepared according to the methods described in, for example, Japanese patent application (OPI) No. 3623/76, Japanese patent application no. 21306/85, etc.

Specific examples of the compounds for use in this invention shown by the above-described general formula (V) or (VI) are illustrated below but they are not intended to limit it in any way. Furthermore, in addition to these illustrated compounds, the compounds described in Japanese patent application (OPI) No. 3623/76 and Japanese patent application no. 21306/85 can be employed in the present invention.

E-1
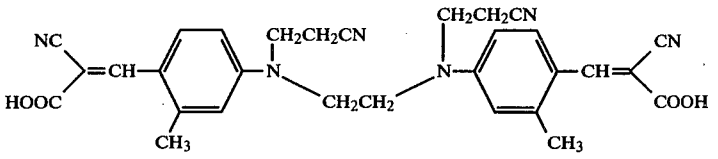
E-2
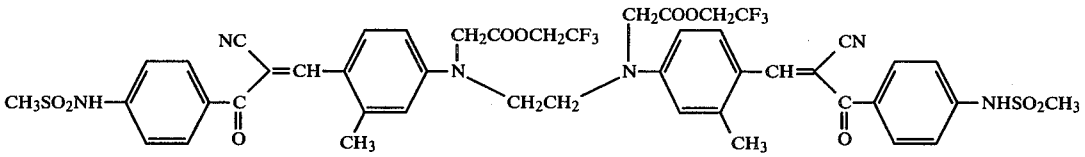
E-3
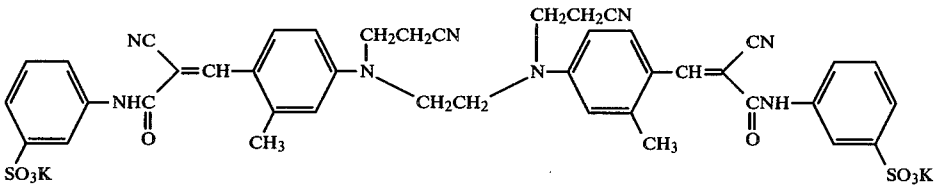
E-4
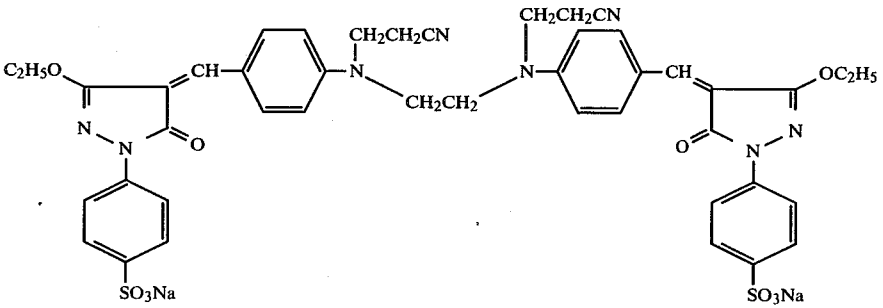

-continued
E-5
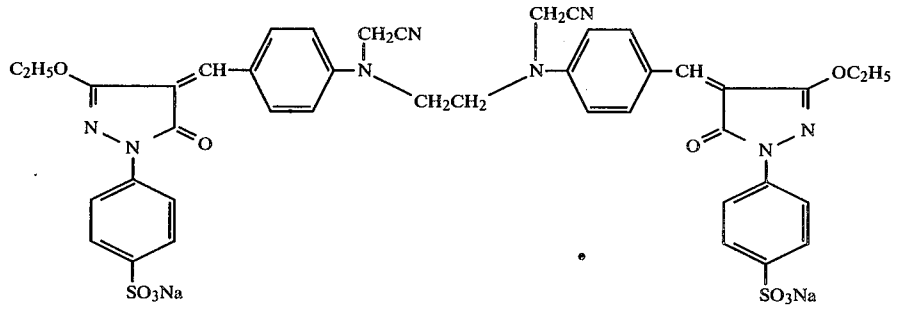
E-6
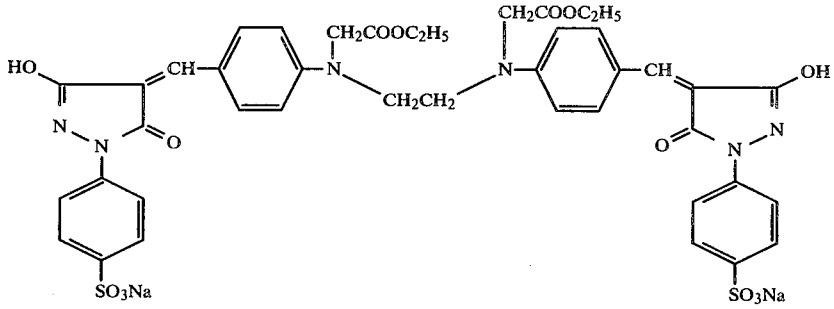
E-7
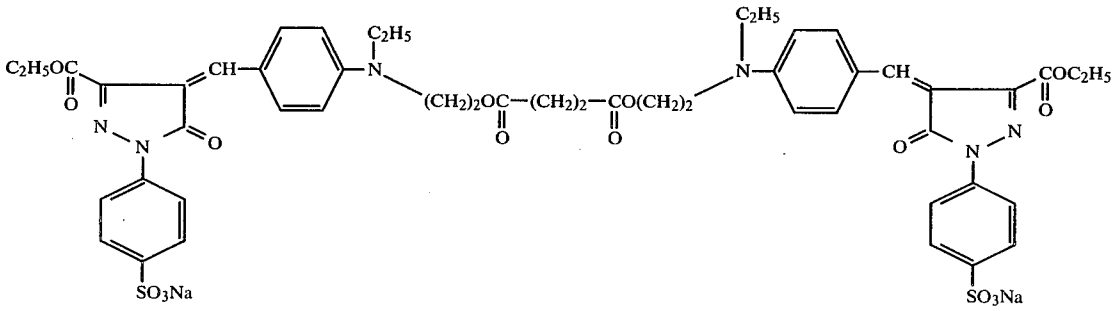

-continued
E-8
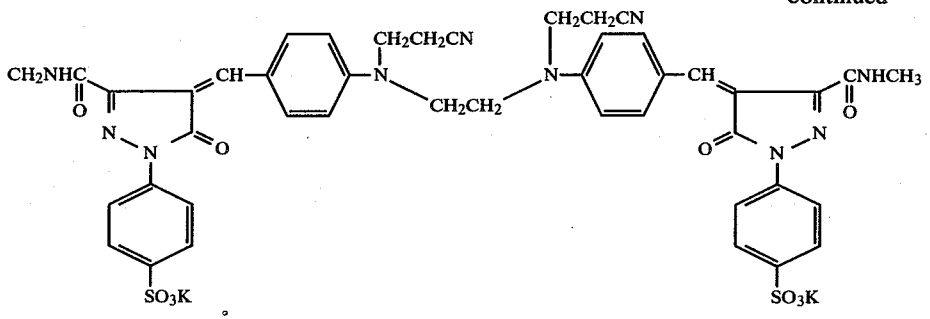
E-9
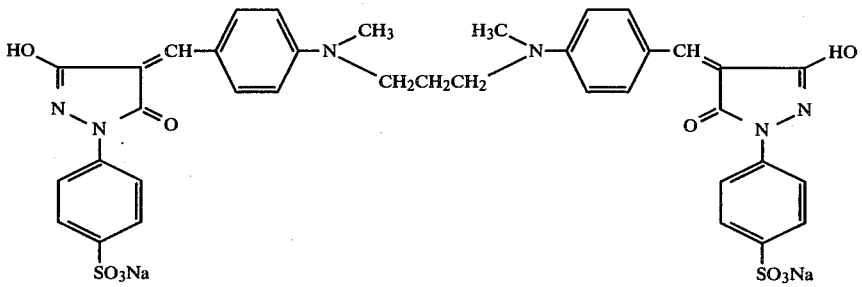
E-10
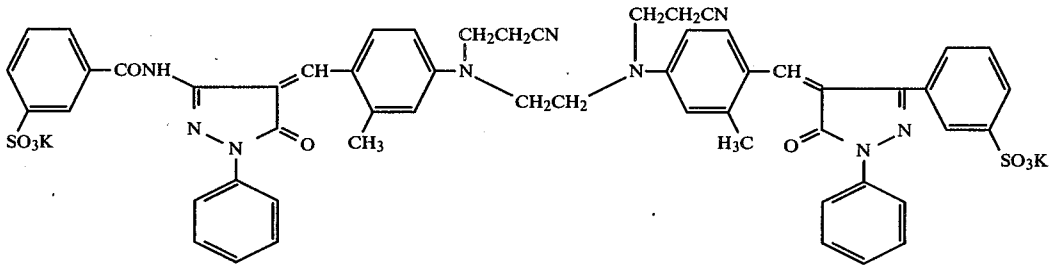
E-11
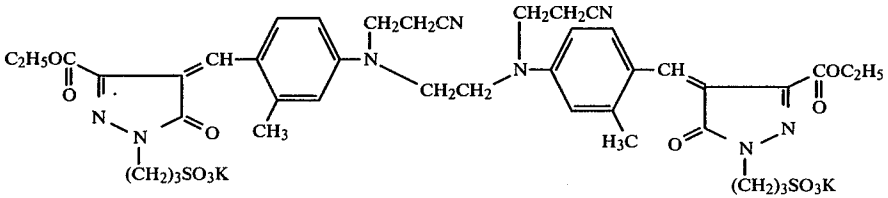

-continued
E-12
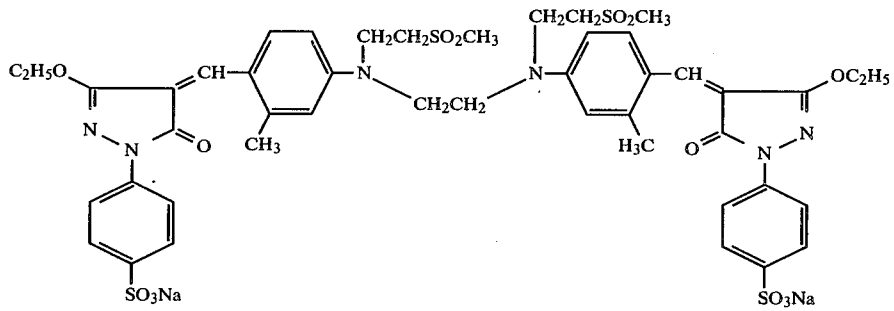
E-13
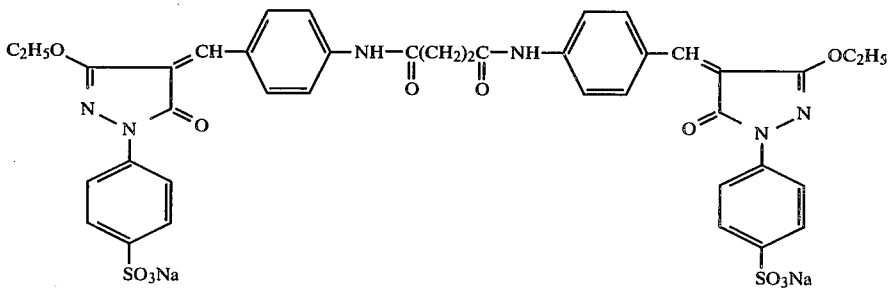
E-14
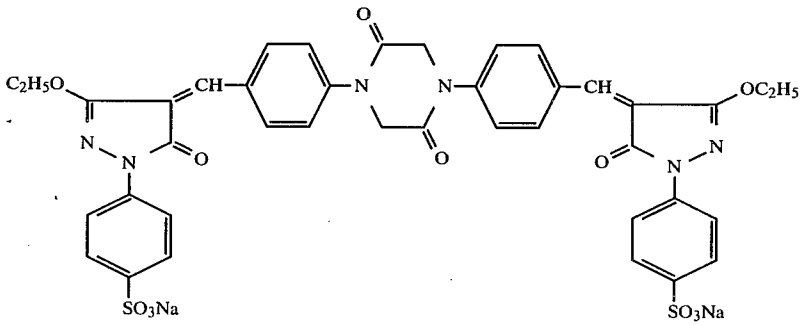

-continued
E-15
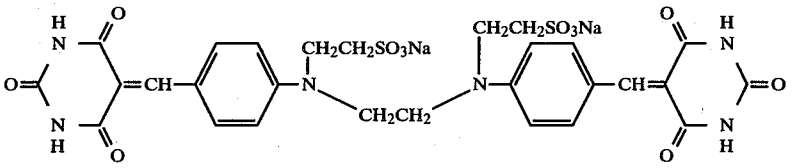
E-16
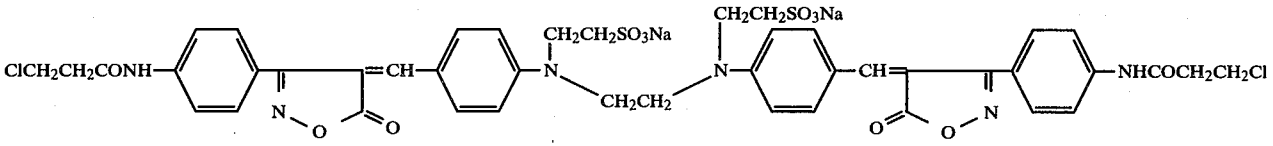
E-17
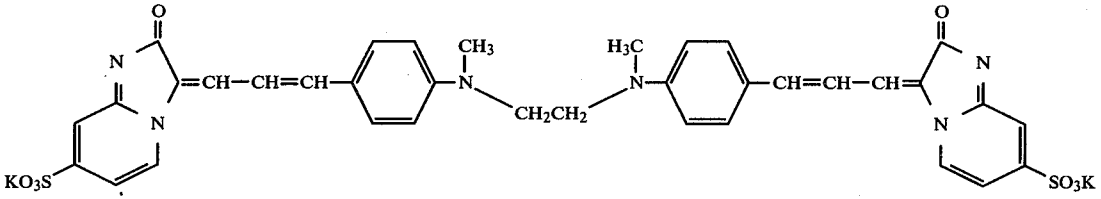
E-18
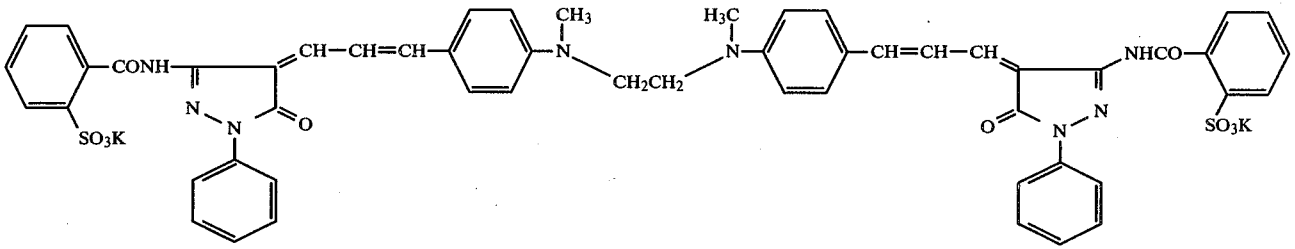
E-19
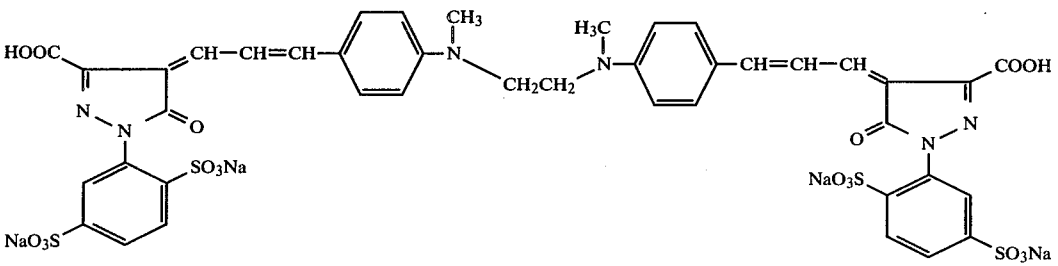

-continued
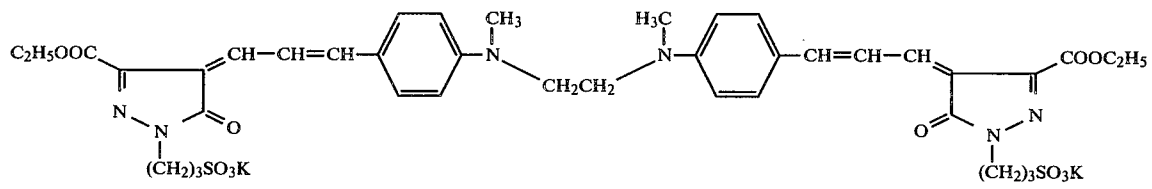
E-20
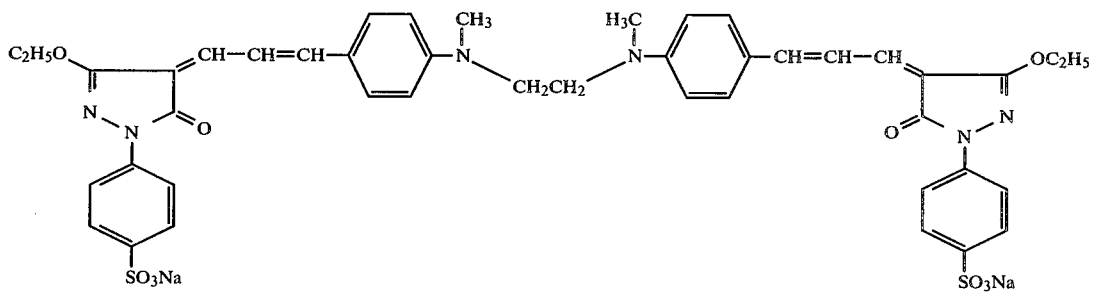
E-21
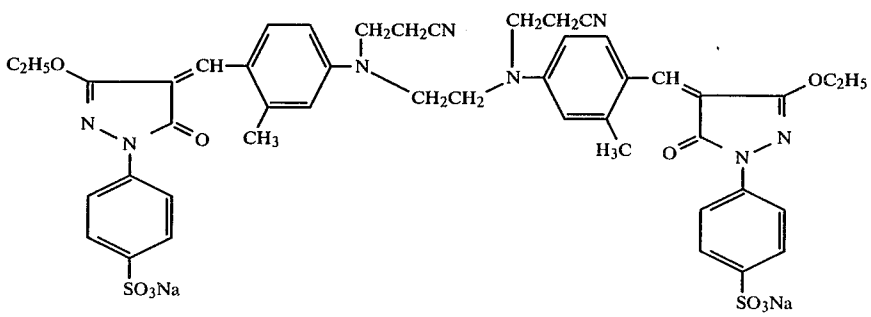
E-22

-continued
E-23
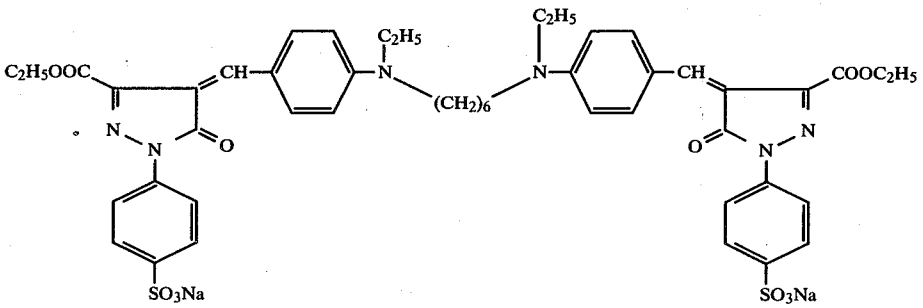
E-24
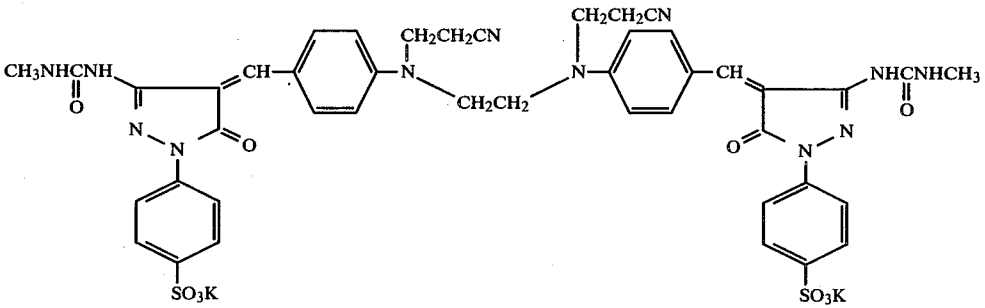
E-25
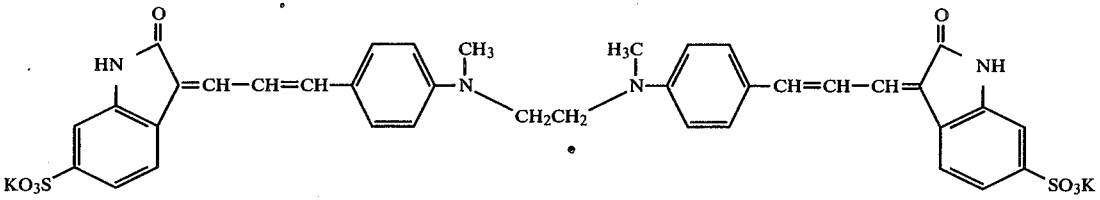
E-26
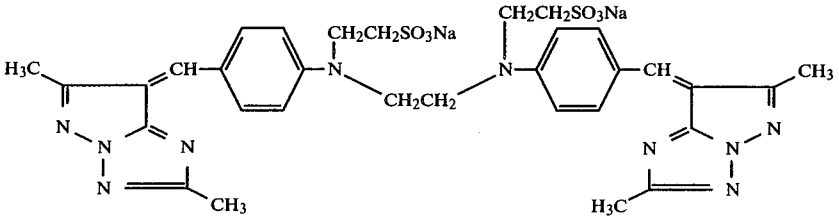

-continued
E-27
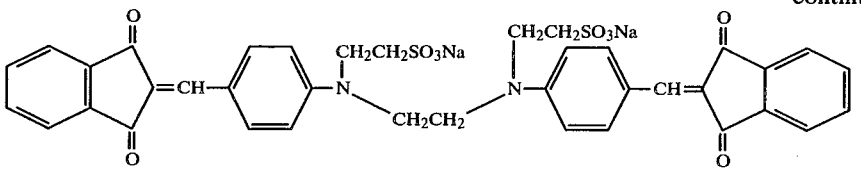
E-28
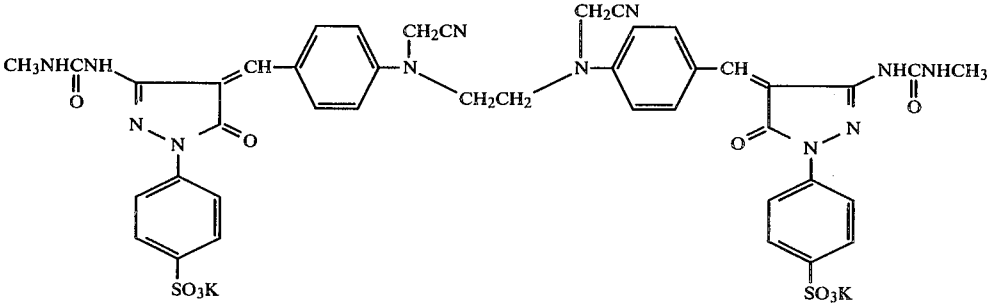

In this invention, a light-insensitive hydrophilic colloid layer is formed on a silver halide emulsion layer, i.e., at the position farther from the support than a silver halide emulsion layer and the dye shown by the above-described general formula (V) or (VI) is incorporated in the light-insensitive layer.

In this case the dye shown by general formula (V) or (VI) selectively dyes the light-insensitive layer to which the dye is added but diffuses very little to other layer(s).

Accordingly, in this invention the sensitivity control and the safe light adaptability can be applied without giving bad influences on the photographic characteristics of the silver halide emulsion, in particular, on the co-reaction of the hydrazine derivative and silver halide.

Also, the dye shown in general formula (V) or (VI) is quickly decolored in photographic processing and further since the dye has two dye moieties in one molecule, the dye has an advantage that the light-insensitive hydrophilic colloid layer can be effectively dyed by the addition of a small amount of the dye.

In the case of using the dye shown by general formula (V) or (VI) for the purposes of improving the safe light adaptability and/or the sensitivity control, the dye having an absorption in the wavelength region of safe light and/or the light exposure wavelength region can be used in an optional amount capable of giving effect and in this case, it is preferred to use the dye so that the optical density becomes in the range of 0.05 to 3.0. These dyes may be used solely or as a combination of two or more. Also, the dye(s) may be added in any step before coating the coating composition.

For incorporating the dye(s) for use in this invention in the light-insensitive layer formed on a silver halide emulsion layer, the dye(s) may be directly dissolved or dispersed in the coating composition for the light-insensitive layer or first dissolved or dispersed in an aqueous solution or a solvent and then added to the above-described coating composition as the solution or the dispersion. As the solvent for use in this case, there are, for example, methanol, ethanol, propanol, methyl cellosolve, the halogenated alcohols described in Japanese patent application (OPI) No. 9715/73, U.S. Pat. No. 3,756,830, etc., acetone, water, pyridine, etc., and mixtures of them.

Also, if necessary, a so-called oil protect method described in U.S. Pat. No. 2,332,027, a method of using polymer latex, a method of using polymer mordant described in Japanese patent application (OPI) No. 193447/84, etc., can be utilized. The use of the polymer mordant together with the dye(s) for use in this invention is particularly preferred.

As a hydrophilic colloid for the light-insensitive hydrophilic colloid layer to which the dye(s) in this invention are added, gelatin is most preferably used and there are various kinds of gelatins. For example, lime-processed gelatin, acid-processed gelatin, etc., can be used. Moreover, the aforesaid gelatin further chemically modified by phthalation or sulfonation, etc., can be used. Also, if necessary, gelatin for use in this invention may be subjected to a desalting treatment.

The mixing ratio of the polymer mordant and gelatin and the coating amount of the polymer mordant can be easily determined by a person skilled in the art according to the amount of the dye to be mordanted, the kind and composition of the polymer mordant, etc., but it is preferred that the mixing ratio of the polymer mordant and gelatin (mordant/gelatin is 20/80 to 80/20 by weight and the coating amount of the polymer mordant is 0.5 to 8 g/m$^2$.

In the field of photographic light-insensitive materials, an auxiliary layer containing a mordanted dye is used as an antihalation layer or a filter layer for color photographic light-insensitive materials but it has never been proposed or practiced to use the above-described auxiliary layer as the upper layer on the silver halide emulsion layer of a black-and-white photographic material for use in printing field as in this invention.

As the silver halide for the silver halide photographic material of this invention, there are silver chloride, silver chlorobromide, silver iodochloride, silver iodobromochloride, etc. Among them, a silver halide composed of at least 50 mol % silver chloride is preferred and a silver halide composed of 70 mol % or more silver chloride is more preferred.

It is preferred that the mean grain size of the silver halide for use in this invention is less than 0.5 $\mu$m. The mean grain size of silver halide is a term which can be easily understood in the field of silver halide photographic science. When the grain is sphere or similar to sphere, the grain size means the diameter of the grain and when the grain is a cube, the grain size is shown by the edge length $\times\sqrt{4/\pi}$. The mean grain size is determined by an algebraic or geometric mean value based on the projected areas of grains. Details of the method of determining the mean grain size are described in C. E. Mees and T. H. James, *The Theory of the Photographic Process,* 3rd Ed., pages 36 to 43 (published by Macmillan Co., 1966).

There is no particular restriction about the form of silver halide grains for use in this invention. That is, the silver halide grains may be of a tubular form, a spherical form, a cubic form, an octahedral form, etc. Also, it is preferred that the grain size distribution of the silver halide grains is narrow and a so-called monodispersed silver halide emulsion wherein about 90%, desirably about 95%, of the entire silver halide grains are in the grain size range of $\pm$40% of the mean grain size is particularly preferred in this invention.

For reacting a soluble silver salt and a soluble halide for obtaining a silver halide, a single jet method, a double jet method, or a combination of them may be used in this invention. Also, a so-called reversal mixing method wherein silver halide grains are formed in the presence of an excessive amount of silver ion can be used.

As one of the double jet method, a so-called controlled double jet method wherein the pAg in a liquid phase for forming silver halide grains is maintained at a constant value can be used and according to the method, a silver halide emulsion wherein the crystal form is regular and the silver halide grain size is almost uniform is obtained.

It is preferred to perform the formation of silver halide grains in an acidic condition. It has been found by our experiments that when the formation of silver halide grains is performed under a neutral or alkaline condition, the effect of this invention is reduced. The pH range is preferably lower than 6, more preferably lower than 5.

For further improving the safe handlable property of the silver halide photographic material in bright room by reducing the sensitivity of the silver halide emulsion in this invention, there are a method of forming silver halide grains by adding an inorganic desensitizer such as a rhodium salt, an iridium salt, cupric chloride, etc., and a method of adding an organic desensitizer such as pinakryptol yellow, phenosafranine, etc., to a silver halide emulsion as described hereinbefore.

In the case of reducing the sensitivity of a silver halide emulsion by forming the silver halide grains in the existence of an inorganic desensitizer, it is preferred to use a water-soluble rhodium salt such as, typically, rhodium chloride, rhodium trichloride, rhodium ammonium chloride, etc., as the desensitizer. Furthermore, the complex salt of the rhodium salt may be used. The addition time of the above-described rhodium salt is limited before the completion of first ripening at the production of the silver halide emulsion and in this case, it is particularly preferred that the rhodium salt is added during the formation of silver halide grains. The addition amount of the rhodium salt is preferably $1\times10^{-6}$ mol to $5\times10^{-2}$ mol, in particular, $1\times10^{-5}$ mol to $1\times10^{-3}$ mol, per mol of silver. The addition amount range of the rhodium salt in this invention overlaps a conventional range of using a rhodium salt but the handlable property of the silver halide photographic material in bright room, the characteristics thereof, such as sensitivity, gamma value, etc., obtained using the rhodium salt in this invention are greatly improved as compared to a conventional case of using the same rhodium salt.

The silver halide emulsions may be or may not be chemically sensitized but from the viewpoint of improving the handlable property of the silver halide photographic light-sensitive material in bright room, the silver halide emulsion(s) are preferably not chemically sensitized. In the case of applying chemical sensitization, a sulfur sensitization, a reduction sensitization, and a gold sensitization may be used individually or as a combination of them.

The silver halide emulsions for use in this invention may be or may not be optically sensitized.

In this invention, two or more silver halide emulsion layers may be formed on a support but usually an employment of one silver halide emulsion layer is enough. The coating amount (or coverage) of silver is preferably in the range of 1 g/m$^2$ to 8 g/m$^2$.

In the case of adding an organic desensitizer such as pinakryptol yellow, phenosafranine, etc., to a silver halide emulsion for reducing the sensitivity of the silver halide emulsion for use in this invention, the addition amount of the desensitizer is preferably $1\times10^{-6}$ mol to $5\times10^{-2}$ mol, in particular, $5\times10^{-5}$ mol to $5\times10^{-3}$ mol.

Preferred examples of the hydrazine derivatives for use in this invention are the arylhydrazides wherein a sulfinic acid residue is bonded to a hydrazo moiety as described in U.S. Pat. No. 4,478,928 as well as the compounds represented by the following general formula (XI):

$$R_{51}\text{-NHNH-G-}R_{52} \qquad \text{(XI)}$$

wherein $R_{51}$ represents an aliphatic or aromatic group; $R_{52}$ represents a hydrogen atom, a substituted or unsubstituted alkyl group, a substituted or unsubstituted aryl group, a substituted or unsubstituted alkoxy group, or a substituted or unsubstituted aryloxy group; and G represents a carbonyl group, a sulfonyl group, a sulfoxy group, a phosphoryl group, or an N-substituted or unsubstituted imino group.

The aliphatic group shown by $R_{51}$ in general formula (XI) has preferably 1 to 30 carbon atoms and is particularly preferably a straight chain, branched or cyclic alkyl group having 1 to 20 carbon atoms. The branched alkyl group may be cyclized in such a manner that a saturated heterocyclic ring containing one or more hereto atoms is formed. Also, the alkyl group may have a substituent such as an aryl group, an alkoxy group, a sulfoxy group, a sulfonamido group, a carbonamido group, etc.

The aromatic group shown by $R_{51}$ in general formula (XI) described above is a monocyclic or bicyclic aryl group or an unsaturated heterocyclic group. In this case, the unsaturated heterocyclic group may be condensed with a monocyclic or bicyclic aryl group to form a heteroaryl group.

Examples of the aforesaid rings are a benzene ring, a naphthalene ring, a pyridine ring, a pyrimidine ring, an imidazole ring, a pyrazole ring, a quinoline ring, an isoquinoline ring, a benzimidazole ring, a thiazole ring, a benzothiazole ring, etc. Among these rings, a benzene ring is preferred.

The particularly preferred aromatic group shown by $R_{51}$ is an aryl group.

The aryl group or the unsaturated heterocyclic group shown by $R_{51}$ may be substituted and specific examples of the substituent are a straight chain, branched or cyclic alkyl group (preferably having 1 to 20 carbon atoms), an aralkyl group (a monocyclic or bicyclic aralkyl group of the alkyl moiety of which has preferably 1 to 3 carbon atoms), an alkoxy group (preferably having 1 to 20 carbon atoms), a substituted amino group (preferably an amino group substituted by an alkyl group of 1 to 20 carbon atoms), an acylamino group (preferably having 2 to 30 carbon atoms), a sulfonamido group (preferably having 1 to 30 carbon atoms), a ureido group (preferably having 1 to 30 carbon atoms), etc.

The alkyl group shown by $R_{52}$ in general formula (XI) is preferably an alkyl group having 1 to 4 carbon atoms and the alkyl group may have a substituent such as a halogen atom, a cyano group, a carboxy group, a sulfo group, an alkoxy group, a phenyl group, etc.

The aryl group shown by $R_{52}$ in general formula (XI), which may be substituted, is a monocyclic or bicyclic aryl group including a group containing benzene ring. The aryl group may have a substituent such as a halogen atom, an alkyl group, a cyano group, a carobxy group, a sulfo group, etc.

The alkoxy group shown by $R_{52}$ in general formula (XI), which may be substituted, is an alkoxy group having 1 to 8 carbon atoms and the alkoxy group may have a substituent such as a halogen atom, an aryl group, etc.

The aryloxy group shown by $R_{52}$ in general formula (XI), which may be substituted, is preferably a monocyclic aryloxy group which may have a substituent such as a halogen atom, etc.

When G in general formula (XI) described above is a carbonyl group, $R_{52}$ in the general formula is preferably a hydrogen atom, a methyl group, a methoxy group, an ethoxy group, or a substituted or unsubstituted phenyl group and is particularly preferably a hydrogen atom.

When G in general formula (XI) is a sulfonyl group, $R_{52}$ is preferably a methyl group, an ethyl group, a phenyl group, or a 4-methylphenyl group and is particularly preferably a methyl group.

When G is a phosphoryl group, $R_{52}$ is preferably a methoxy group, an ethoxy group, a butoxy group, a phenoxy group, or a phenyl group and particularly preferably is a phenoxy group.

When G is a sulfoxy group, $R_{52}$ is a cyanobenzyl group, a methylthiobenzyl group, etc.

When G is an N-substituted or unsubstituted imino group, $R_{52}$ is preferably a methyl group, an ethyl group or a substituted or unsubstituted phenyl group.

Also, $R_{51}$ or $R_{52}$ in general formula (XI) may have a ballast group which is ordinarily employed for immobile or nondiffusible photographic additives such as couplers. The ballast group is a group having at least 8 carbon atoms and relatively innert to photographic property. Examples of ballast groups are an alkyl group, an alkoxy group, a phenyl group, an alkylphenyl group, a phenoxy group, an alkylphenoxy group, etc.

$R_{51}$ or $R_{52}$ in general formula (XI) may have therein a group capable of increasing the absorption power for the surfaces of silver halide grains. Examples of such an adsorptive group are a thiourea group, a heterocyclic thioamido group, a mercapto heterocyclic group, a triazole group, etc., described in U.S. Pat. No. 4,385,108.

G in general formula (XI) is particularly preferably a carbonyl group.

Specific examples of the compound shown by general formula (XI) are illustrated below but are not intended to limit the invention in any way.

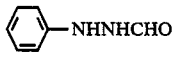

XI-1

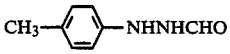

XI-2

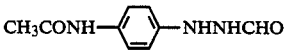

XI-3

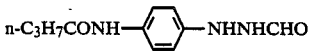

XI-4

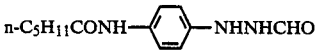

XI-5

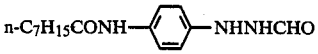

XI-6

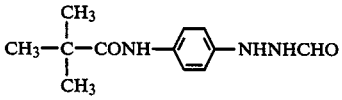

XI-7

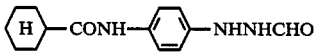

XI-8

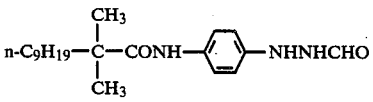

XI-9

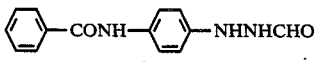

XI-10

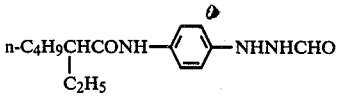

XI-11

-continued

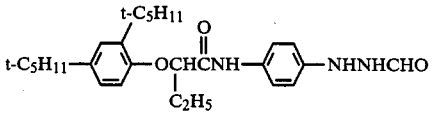

XI-12

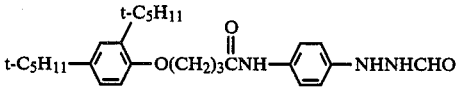

XI-13

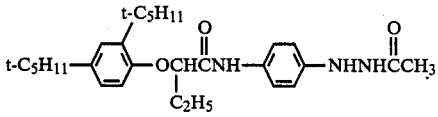

XI-14

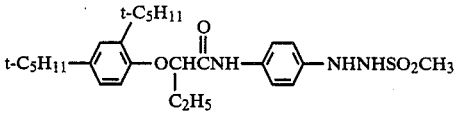

XI-15

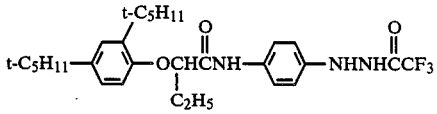

XI-16

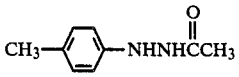

XI-17

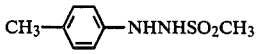

XI-18

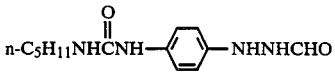

XI-19

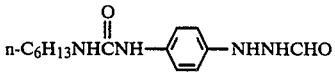

XI-20

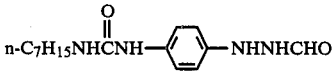

XI-21

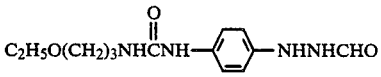

XI-22

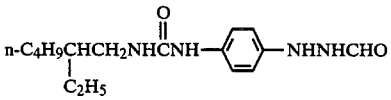

XI-23

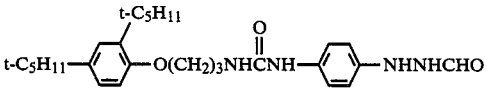

XI-24

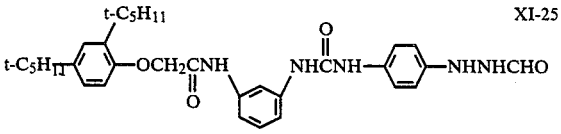

XI-25

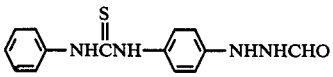

XI-26

-continued

XI-27

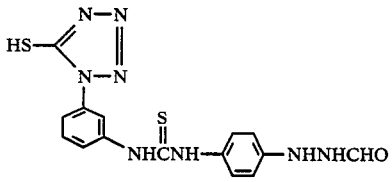

XI-28

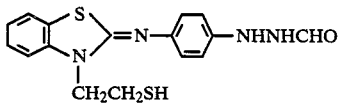

XI-29

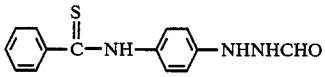

XI-30

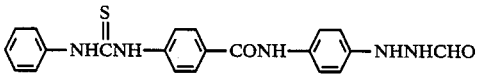

XI-31

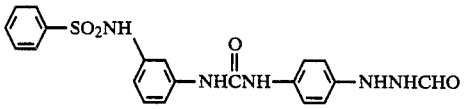

It is preferred that the hydrazine derivative for use in this invention is incorporated in an amount of $1\times10^{-6}$ mol to $5\times10^{-2}$ mol, particularly $1\times10^{-5}$ mol to $2\times10^{-2}$ mol, per mol of silver halide.

For incorporating the hydrazine derivative in the photographic light-sensitive material of this invention, the hydrazine derivative may be added to a silver halide emulsion solution or a hydrophilic colloid solution as an aqueous solution thereof when the derivative is water-soluble or as a solution of water-miscible organic solvent such as an alcohol (e.g., methanol, ethanol, etc.), an ester (e.g., ethyl acetate, etc.), or a ketone (e.g., acetone, etc.), when the derivative is water-insoluble.

In this invention, when at least one of the compounds represented by the following general formulae (A) and (B) is used together for the photographic light-sensitive material, a higher contrast is obtained and the tone controllability of the width of the line image and the tone controllability of the halftone dot image are more improved. The above-described compound may be added to the silver halide emulsion layer, other hydrophilic colloid layer, or both layers:

(A)

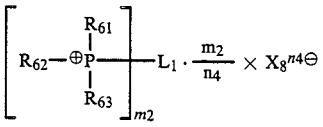

wherein $R_{61}$, $R_{62}$ and $R_{63}$ each represents an alkyl group, a cycloalkyl group, an aryl group, an alkenyl group, a cycloalkenyl group, or a heterocyclic residue and they may have a substituent; $m_2$ represents an integer; $L_1$ represents an $m_2$-valent organic group bonded to the P atom with the carbon atom thereof; $n_4$ represents an integer of 1 to 3; and $X_8$ represents an $n_4$-valent anion; said $X_8$ may be combined with said $L_1$.

Examples of the groups shown by $R_{61}$, $R_{62}$ and $R_{63}$ are a straight chain or branched alkyl group such as a methyl group, an ethyl group, a propyl group, an isopropyl group, a butyl group, an isobutyl group, a secbutyl group, a tert-butyl group, an octyl group, a 2-ethylhexyl group, a dodecyl group, a hexadecyl group, an octadecyl group, etc.; a cycloalkyl group such as a cyclopropyl group, a cyclopentyl group, a cyclohexyl group, etc.; an aryl group such as a phenyl group, a naphthyl group, a phenanthryl group, etc.; an alkenyl group such as an allyl group, a vinyl group, a 5-hexenyl group, etc.; a cycloalkenyl group such as a cyclopentenyl group, a cyclohexenyl group, etc.; a heterocyclic residue such as a pyridyl group, a quinolyl group, a furyl group, an imidazolyl group, a thiazolyl group, a thiadiazolyl group, a benzotriazolyl group, a benzothiazolyl group a morpholyl group, a pyrimidyl group, a pyrrolidyl group, etc.

Also, examples of the substituent for these groups are, in addition to the groups shown by $R_{61}$, $R_{62}$ or $R_{63}$ described above, a halogen atom such as a fluorine atom, a chlorine atom, a bromine atom, an iodine atom, etc., a nitro group, a primary, secondary or tertiary amine, an alkyl ether, an aryl ether, an alkyl thioether, an aryl thioether, a carbonamido group, a carbamoyl group, a sulfonamido group, a sulfamoyl group, a hydroxy group, a sulfoxy group, a sulfonyl group, a carboxy group, a sulfonic acid group, a cyano group, and a carbonyl group.

Examples of the group shown by $L_1$ in general formula (A) are, in addition to the groups shown by $R_{61}$, $R_{62}$ and $R_{63}$ described above, a polymethylene group such as a trimethylene group, a tetramethylene group, a hexamethylene group, a pentamethylene group, an octamethylene group, a dodecamethylene group, etc.; a divalent aromatic group such as a phenylene group, a biphenylene group, a naphthylene group, etc.; a polyvalent aliphatic group such as a trimethylenemethyl group, a tetramethylenemethyl group, etc.; and a polyvalent aromatic group such as a phenylene-1,3,5-toluyl group, a phenylene-1,2,4,5-tetrayl group, etc.

Examples of the anion shown by $X_8$ in general formula (A) are a halogen ion such as a chlorine ion, a bromine ion, an iodine ion; a carboxylate ion such as an acetate ion, an oxalate ion, a fumarate ion, a benzoate ion, etc.; a sulfonate ion such as a p-toluenesulfonate ion, a methanesulfonate ion, a butanesulfonate ion, a benzenesulfonate ion, etc.; a sulfate ion, a perchlorate ion, a carbonate ion, a nitrate ion, etc.

The particularly preferred compounds shown by general formula (A) above are those of the formula wherein $m_2$ is an integer of 1 or 2, $L_1$ is the group having up to 20 carbon atoms included in the same groups shown by $R_{61}$, $R_{62}$ or $R_{63}$ or a divalent organic group having up to 20 carbon atoms bonded to the P atom by the carbon atom thereof, $n_4$ is an integer of 1 or 2, and $X_8$ is a monovalent or divalent anion, said $X_8$ may be bonded to $L_1$.

Many of the compounds shown by general formula (A) are known and some of them are commercially available as reagents. The compounds of general formula (A) can be generally prepared by a method of reacting a phosphinic acid and an alkylating agent such as a halogenated alkyl, a sulfonic acid ester, etc., or a method of exchanging the counter ion of a phosphonium salt.

Specific examples of the compounds shown by general formula (A) are illustrated below but are not intended to limit the invention in any way.

A-1
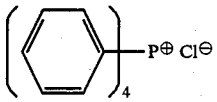
A-2
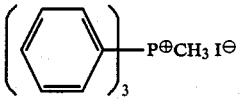
A-3
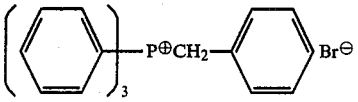
A-4
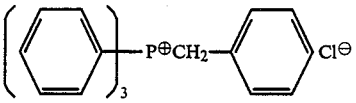
A-5
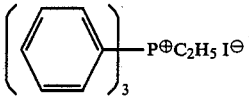
A-6 $(n\text{-}C_4H_9)_4P^{\oplus}\ Br^{\ominus}$
A-7
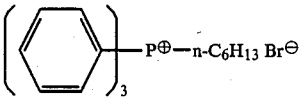
A-8
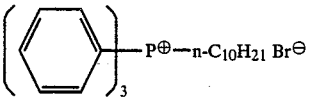
A-9
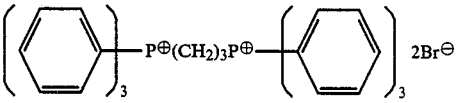
A-10
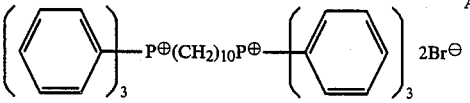
A-11
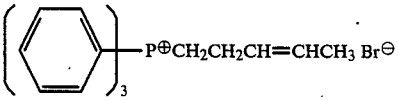
A-12
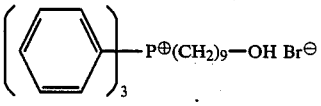
A-13
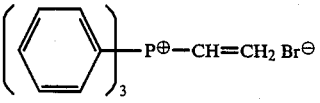
-continued
A-14
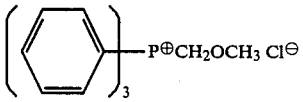
A-15
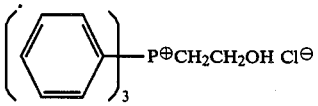
A-16 $Ph_3P^{\oplus}-(CH_2)_4COOH\ Br^{\ominus}$
A-17
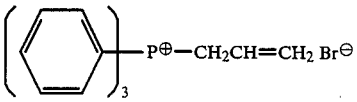
A-18 $(n\text{-}C_4H_9)_3P^{\oplus}-n\text{-}C_{16}H_{33}\ Br^{\ominus}$
A-19
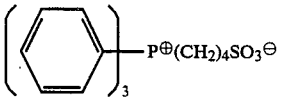
A-20
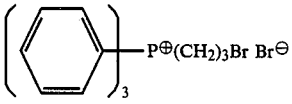
A-21
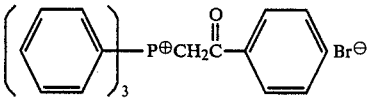
A-22
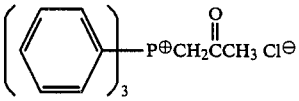
A-23 $(n\text{-}C_4H_9)_3P^{\oplus}CH_2CH_2OH\ Br^{\ominus}$
A-24 $(n\text{-}C_4H_9)_3P^{\oplus}C_2H_5.\frac{1}{2}SO_4^{2\ominus}$
A-25
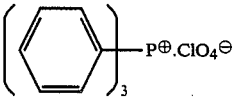
A-26
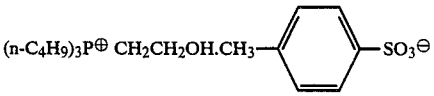
A-27 $(n\text{-}C_4H_9)_3P^{\oplus}CH_3\ I^{\ominus}$
A-28 $(HOCH_2)_3P^{\oplus}CH_3\ I^{\ominus}$
A-29
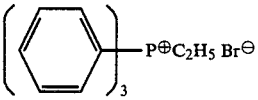
A-30
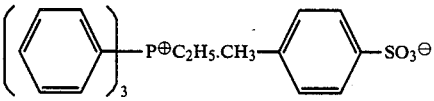

It is preferred that the additional amount of the compound shown by general formula (A) is $1\times10^{-6}$ mol to $1\times10^{-1}$ mol, particularly $1\times10^{-5}$ mol to $5\times10^{-2}$ mol, per mol of silver halide contained in the silver halide emulsion layer of the light-sensitive material of this invention.

$$R_{71}\text{-S-S-}R_{72} \qquad \text{(B)}$$

wherein $R_{71}$ and $R_{72}$ each represents an aliphatic group an aromatic group or a heterocyclic residue; said $R_{71}$ and $R_{72}$ may be the same or different. Also, when $R_{71}$ and $R_{72}$ are an aliphatic group, said $R_{71}$ and $R_{72}$ may form a ring.

The compounds shown by general formula (B) are explained below more in detail.

As the aliphatic group shown by $R_{71}$ and $R_{72}$ in general formula (B), there are a straight chain or branched alkyl group, an alkenyl group, an alkinyl group, and a cycloalkyl group.

The aforesaid alkyl group has 1 to 18 carbon atoms and examples thereof are a methyl group, an ethyl group, a propyl group, a butyl group, a hexyl group, a decyl group, a dodecyl group, an isopropyl group, a t-butyl group, a 2-ethylhexyl group, etc.

The aforesaid alkenyl group has 2 to 20 carbon atoms and examples thereof are an allyl group, a 2-butenyl group, a 7-octenyl group, etc.

The aforesaid alkinyl group has 2 to 20 carbon atoms and examples thereof are a propargyl group, a 2-butinyl group, etc.

The aforesaid cycloalkyl group has 3 to 12 carbon atoms and examples thereof are a cyclopropyl group, a cyclopentyl group, a cyclohexyl group, a cyclododecyl group, etc.

The aromatic group shown by $R_{71}$ and $R_{72}$ in general formula (B) has 6 to 20 carbon atoms and examples thereof are a phenyl group, a naphthyl group, etc.

The heterocyclic residue shown by $R_{71}$ and $R_{72}$ is a 3- to 7-membered ring composed of at least one of a nitrogen atom, an oxygen atom, and a sulfur atom and carbon atoms and the residue may be fused with a benzene ring.

As the heterocyclic ring for $R_{71}$ and $R_{72}$, there are pyrrolidine, piperidine, tetrahydrofuran, tetrahydropyran, oxirane, pyrrole, pyridine, furan, thiophene, imidazoline, pyrazolidine, imidazole, pyrazole, pyrazine, pyrimidine, morpholine, oxazole, thiazol, triazole, tetrazole, thiadiazole, oxadiazole, and the above described rings fused with a benzene ring.

The ring formed by $R_{71}$ and $R_{72}$ is a 4- to 7-membered ring and examples of these rings are:

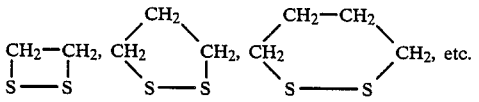

Examples of the substituent for $R_{71}$ and $R_{72}$ in general formula (B) are an alkyl group(having 1 to 12 carbon atoms, such as a methyl group, an ethyl group, a butyl group, a decyl group, etc.), an alkenyl group (having 2 to 12 carbon atoms, such as an allyl group, a 2-butenyl group, etc.), an alkinyl group (having 2 to 12 carbon atoms, such as a propargyl group, a 2-butinyl group, etc.), a cycloalkyl group (having 3 to 12 carbon atoms, such as a cyclopropyl group, a cyclohexyl group, etc.), an aryl group (having 6 to 10 carbon atoms, such as a phenyl group, etc.), a halogen atom (e.g., a fluorine atom, a chlorine atom, a bromine atom, an iodine atom, etc.), an alkoxy group (having 1 to 10 carbon atoms, such as a methoxy group, an ethoxy group, a hexyloxy group, etc.), an aryloxy group (having 6 to 10 carbon atoms, such as a phenoxy group, etc.), a carboxy group, an alkoxycarbonyl group (having 2 to 20 carbon atoms, such as a methoxycarbonyl group, an ethoxycarbonyl group, etc.), an aryloxycarbonyl group (having 7 to 11 carbon atoms, such as a phenoxycarbonyl group, etc.), an amino group, an acyl group (having 1 to 20 carbon atoms, such as an acetyl group, etc.), a carbamoyl group, a hydroxy group, an acyloxy group (having 2 to 20 carbon atoms, such as an acetoxy group, etc.), an arylyloxy group (having 7 to 11 carbon atoms, such as a benzoyloxy group, etc.), an amido group (having 1 to 20 carbon atoms, such as an acetamido group, a hexaneamido group, a benzamido group, etc.), a sulfo group, a sulfonyl group (having 1 to 12 carbon atoms, such as a methanesulfonyl group, a benzenesulfonyl group, etc.), an alkylthio group (having 1 to 20 carbon atoms, such as a methylthio group, an ethylthio group, a hexadecylthio group, etc.), an arylthio group (having 6 to 10 carbon atoms, such as a phenylthio group, etc.), a sulfamoyl group, an alkyldisulfido group (having 1 to 20 carbon atoms, such as a methyldisulfido group, etc.), a sulfonamido group (having 1 to 20 carbon atoms, such as a methanesulfonamido group, a benzenesulfonamido group, etc.), a ureido group (having 1 to 20 carbon atoms, such as a methylureido group, a phenylureido group, etc.), a thioureido group (having 1 to 20 carbon atoms, such as a methylthioureido group, a phenylthioureido group, etc.), a thioamido group (having 1 to 20 carbon atoms, such as a thioacetamido group, a thiobenzamido group, etc.), a cyano group, and a nitro group.

$R_{71}$ and $R_{72}$ each may have a single or plural substituents selected from the above-described ones. Also, the above substituents may be further substituted by the substituent as illustrated above.

$R_{71}$ and $R_{72}$ are preferably an aliphatic group and form more preferably a ring with them. $R_{71}$ and $R_{72}$ are particularly preferably the group shown by

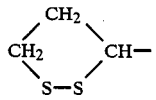
(substituent).

Specific examples of the compound shown by general formula (B) are illustrated below but are not intended to limit the invention in any way.

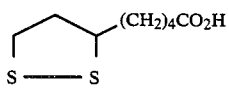
B-1

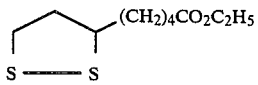
B-2

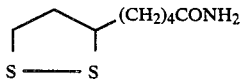
B-3

-continued

B-4

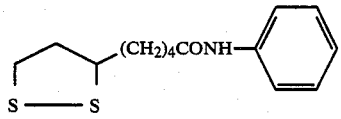

B-5

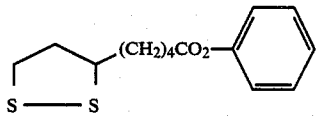

B-6

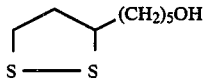

B-7

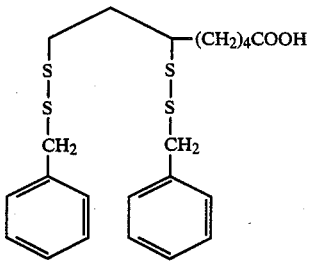

B-8

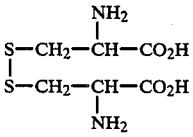

B-9

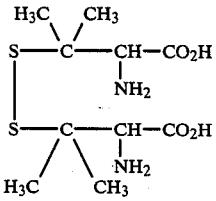

B-10

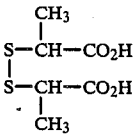

B-11

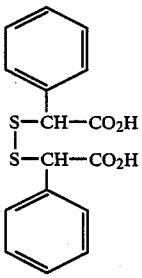

B-12 n-$C_4H_9$—S—S—$C_4H_9$—n

B-13

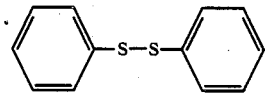

-continued

B-14

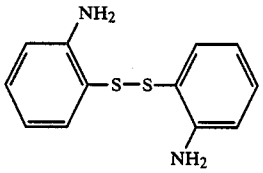

B-15

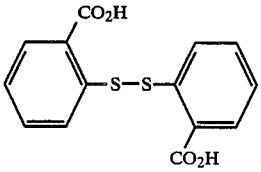

B-16

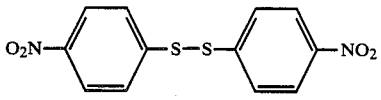

B-17

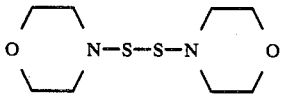

B-18

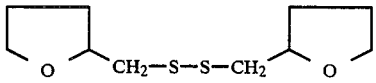

In this invention, it is preferred that the addition amount of the compound shown by general formula (B) is $1\times10^{-7}$ mol to $1\times10^{-2}$ mol, particularly $1\times10^{-6}$ to $5\times10^{-3}$ mol, per mol of silver halide.

For incorporating the compound shown by general formula (A) or (B) described above, the compound may be added to a silver halide emulsion solution or an aqueous hydrophilic colloid solution as an aqueous solution thereof when the compound is water-soluble or as a solution of a water-miscible organic solvent such as an alcohol (e.g., methanol, ethanol, etc.), an ester (e.g., ethyl acetate, etc.), a ketone (e.g., acetone, etc.), etc., when the compound is water-insoluble.

In this invention the compounds which are usually used as antifoggants, such as a benzotriazole compound and/or a mercapto compound represented by the following general formula (XII) can be used together. These compounds are used as not only a simple antifoggant but also an agent for improving letter image quality.

One of the preferred compounds is a benzotriazole compound which may be substituted by one or more substituents such as an alkyl group (e.g., a methyl group, an ethyl group, a heptyl group, etc.), an alkoxy group, a halogen atom, an acyl group, an acylamino group, a carbamoyl group, a sulfamoyl group, an aryl group, etc., and in particular, benzotriazole substituted by an alkyl group having 1 to 3 carbon atoms is effective. Also, the effective addition amount of the compound is in the range of $1\times10^{-4}$ mol to $1\times10^{-2}$ mol, particularly $5\times10^{-4}$ to $5\times10^{\times3}$ mol, per mol of silver halide.

Another preferred compound which can be used in this invention is represented by general formula (XII) as described above.

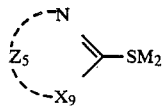

(XII)

wherein $M_2$ represents a hydrogen atom, —$NH_4$, or an alkali metal atom; $X_9$ represents a group shown by —NR' (wherein R' represents a hydrogen atom, an alkyl group which may be substituted, an aryl group which may be substituted, or an aralkyl group which may be substituted), a sulfur atom, or an oxygen atom; and $Z_5$ represents an atomic group necessary for forming a 5-membered heterocyclic ring (e.g., tetrazole, triazole, imidazole, thiazole, etc.) or a 5-membered heterocyclic ring condensed with a benzene ring (e.g., benzimidazole, benzothiazole, benzoxazole, etc.). These heterocyclic rings may be substituted by an alkyl group, an alkoxy group, a carboxy group, a sulfo group, a hydroxy group, an amino group, a nitro group, a halogen atom, a carbamoyl group, an alkylthio group, a mercapto group, etc. The compound of aforesaid general formula (XII) wherein $Z_5$ is tetrazole, triazole, thiazole, benzimidazole, or benzothiazole is preferred and also the compound wherein $Z_5$ is tetrazole is most preferred.

Specific examples of the preferred compounds shown by general formula (XII) are illustrated below.

XII-1

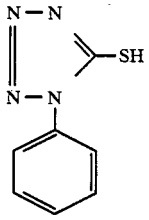

XII-2

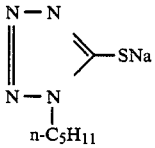

XII-3

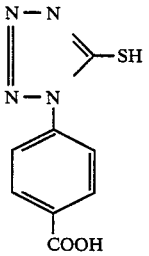

XII-4

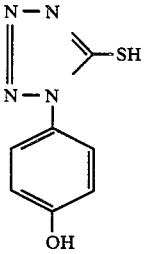

-continued

XII-5

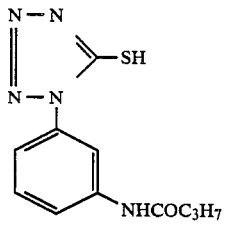

XII-6

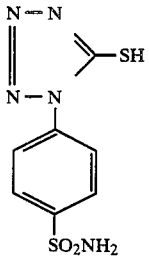

XII-7

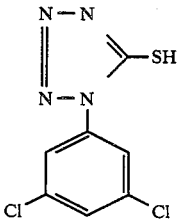

XII-8

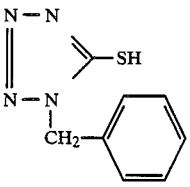

XII-9

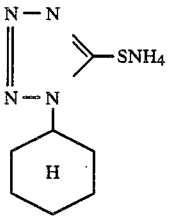

XII-10

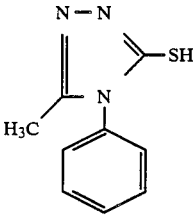

XII-11

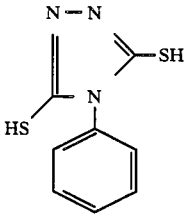

-continued

XII-12

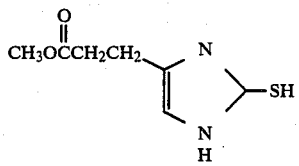

XII-13

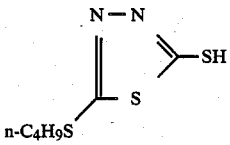

XII-14

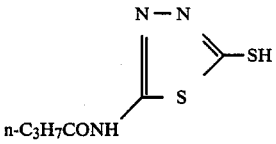

XII-15

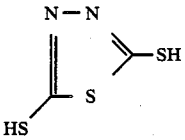

XII-16

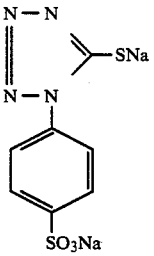

XII-17

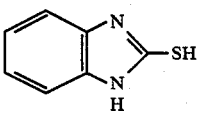

XII-18

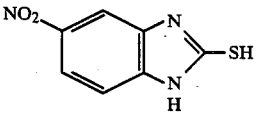

XII-19

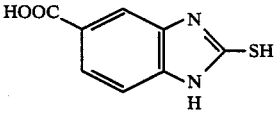

XII-20

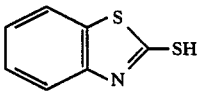

XII-21

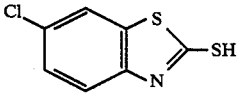

-continued

XII-22

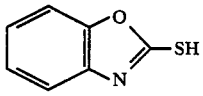

The effective addition amount of the abovedescribed compound is in the range of $5\times10^{-5}$ to $1\times10^{-3}$ mol per mol of silver halide.

The silver halide photographic emulsion for use in this invention may contain or may not contain an irradiation preventing dye. In a conventional photographic light-sensitive material for bright room, a dye added to the silver halide emulsion thereof for improving the handlable property of the light-sensitive material in bright room has a side absorption in an ultraviolet region, whereby the occurrence or irradiation is prevented, but by such a manner, it is difficult to independently control the handlable property in bright room and irradiation prevention. On the other hand, in this invention, the dye for improving the handlable property of the light-sensitive material in bright room exists in the light-insensitive hydrophilic colloid layer only formed on a silver halide emulsion layer of the light-sensitive material, and hence the irradiation prevention of the silver halide emulsion and the handlable property of the light-sensitive material in bright room can be independently controlled. As the irradiation preventing dye for use in this invention, a dye having a main absorption in the light exposure wavelength region, for example, an ultraviolet absorption dye can be used.

As the ultraviolet absorption dye for use in this invention, there are a benzotriazole compound substituted by an aryl group, a 4-thiazolidone compound, a benzophenone compound, a cinnamic acid ester compound, a butadiene compound, a benzoxazole compound, and further ultraviolet absorptive polymers. The ultraviolet absorption dye can be fixed in the aforesaid hydrophilic colloid layer.

Specific examples of the ultraviolet absorption dyes for use in this invention are described in U.S. Pat. Nos. 3,533,794, 3,314,794, 3,352,681, Japanese patent application (OPI) No. 2784/71, U.S. Pat. Nos. 3,705,805, 3,707,375, 4,045,229, 3,700,455, 3,499,762, West German patent publication No. 1,547,863, etc.

The silver halide emulsion and the hydrophilic colloid for use in this invention may further contain an inorganic or organic hardening agent, such as a chromium salt (e.g., chromium alum, chromium acetate, etc.), an aldehyde (e.g., formaldehyde, glyoxal, glutaraldehyde, etc.), an N-methylol compound (dimethylolurea, methyloldimethylhydantoin, etc.), a dioxane derivative (2,3-dihydroxydioxane, etc.), an active vinyl compound (e.g., 1,3,5-triacryloyl-hexahydro-s-triazine, bis(vinylsulfonyl)methyl ether, N,N'-methylenebis[β-(vinylsulfonyl)propionamido], etc.), an active halogen compound (e.g., 2,4-dichloro-6-hydroxy-s-triazine, etc.), a mucohalogenic acid (e.g., mucochloric acid, mucophenoxychloric acid, etc.), an isoxazole, a dialdehyde starch, a 2-chloro-6-hydroxytriazinylated gelatin, etc. They can be used solely or as a combination of them.

Specific examples of the hardening agent are described in U.S. Pat. Nos. 1,870,354, 2,080,019, 2,726,162, 2,870,013, 2,983,611, 2,992,109, 3,047,394, 3,057,723, 3,103,437, 3,321,313, 3,325,287, 3,362,827, 3,539,644, 3,543,292, British Pat. Nos. 676,628, 825,544, 1,270,578, German Pat. Nos. 872,153, 1,090,427, Japanese patent publication Nos. 7133/59, 1872/71, etc.

For the silver halide emulsion layer and/or the light-insensitive hydrophilic colloid layer of the light-sensitive material of this invention may be used various surface active agents as a coating aid or for various purposes of antistatic prevention, improvement of slidability, improvement of dispersing property, prevention of adhesion, and improvement of photographic characteristics.

In the case of using a mordant, it is preferred to use an anionic surface active agent and an amphoteric surface active agent together with the mordant for facilitating the coating of the coating composition and improving the mordanting property.

Both the surface active agents may be added to a coating composition of the light-insensitive hydrophilic colloid layer or the coating composition for the silver halide emulsion layer and the using amounts and the using ratio of them are optional and can be simply determined by experiments.

As the anionic group of the anionic surface active agent for use in this invention, there are a sulfonic acid group, a carboxylic acid group, a phosphoric acid group, etc., and as the hydrophobid moiety of the surface active agent, there are hydrocarbons and partially or wholly fluorized hydrocarbons.

Specific examples of the anionic surface active agent for use in this invention are illustrated below but are not intended to limit the invention in any way.

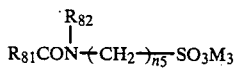
(C-1)

wherein $R_{81}$ represents a saturated or unsaturated hydrocarbon group having 3 to 20 carbon atoms or a fluorinesubstituted product thereof; $R_{82}$ represents a hydrogen atom, a methyl group, an ethyl group, or a propyl group; $n_5$ represents an integer of 1 to 20, in particular, 1 to 8; and $M_3$ represents a monovalent alkali metal, preferably Na or K.

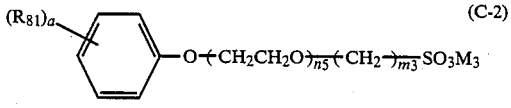
(C-2)

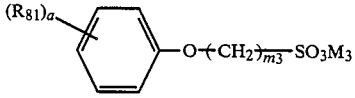
(C-3)

In formulae (C-2) and (C-3), $R_{81}$, $M_3$ and $n_5$ have the same significance as defined in general formula (C-1); a represents 0, 1 or 2; and $m_3$ represents an integer of 1 to 6, preferably 2 to 4.

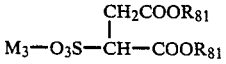
(C-4)

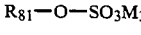
(C-5)

-continued

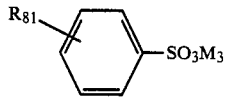
(C-6)

In the above formulae (C-4), (C-5) and (C-6), $R_{81}$ and $M_3$ have the same significance as defined in general formula (C-1).

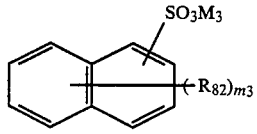
(C-7)

wherein $R_{82}$ and $M_3$ have the same significance as defined in general formula (C-1) and $m_3$ has the same significance as defined in general formula (C-2).

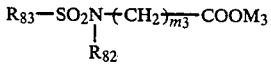
(C-8)

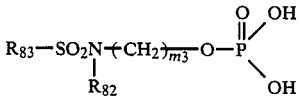
(C-9)

In general formulae (C-8) and (C-9), $R_{83}$ represents a saturated or unsaturated hydrocarbon group having 3 to 22, preferably 7 to 18, carbon atoms and having a fluorinated hydrogen moiety; $R_{82}$ and $M_3$ have the same significance as defined in general formula (C-1); and $m_3$ has the same significance as defined in general formula (C-2).

Specific examples of the particularly preferred anionic surface active agents for use in this invention are shown below.

$C_{11}H_{23}CONHCH_2SO_3Na$ C-1

$C_7F_{15}CONH(CH_2)_2SO_3Na$ C-2

$C_8H_{17}CON(CH_2)_2SO_3K$ (with $CH_3$ on N) C-3

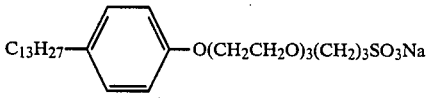
C-4

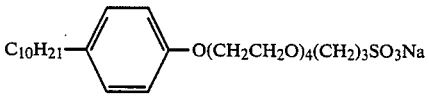
C-5

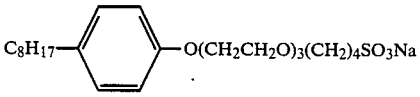
C-6

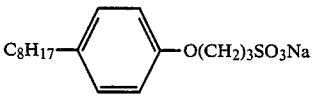
C-7

-continued

C-8 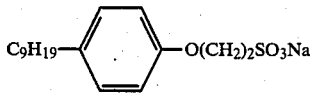

C-9 $CH_2-COOC_8H_{17}$
$NaO_3S-CH-COOC_8H_{17}$

C-10 $C_7H_{15}-O-SO_3K$

C-11 $C_{12}H_{25}O-SO_3Na$

C-12 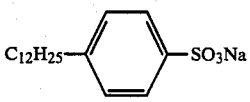

C-13 $C_8F_{17}-SO_2NH(CH_2)_3COONa$

C-14 $C_{17}F_{33}-SO_2NH(CH_2)_4COONa$

C-15 $C_{13}F_{27}SO_2NH(CH_2)_3OPO(OH)_2$

C-16 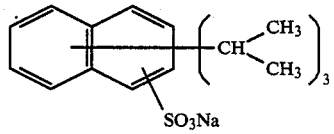

The amphoteric surface active agent for use in this invention is a surface active agent having an anionic group and a cationic group in the molecule thereof and forming an intramolecular salt. The surface active agent is represented by the following general formula (D):

$$A_1^{\ominus}-C^{\oplus}$$

wherein $A_1^{\ominus}$ represents an anionic residue having an anionic group such as a sulfonic acid group, a carboxylic acid group, a phosphoric acid group, etc., and $C^{\oplus}$ represents an organic cation residue.

Specific examples of the preferred amphoteric surface active agent are as follows.

D-1 (10-Carboxydecyl)dimethyldodecylammonium hydroxide
D-2 (2-Carboxyethyl)dimethyldodecylammonium hydroxide
D-3 (3-Sulfopropyl)dimethyldodecylammonium hydroxide
D-4 (4-Sulfobutyl)diethyldodecylammonium hydroxide
D-5 (2-Carboxyethyl)dimethyloctadecylammonium hydroxide
D-6 (3-Sulfopropyl)dimethyloctadecylammonium hydroxide
D-7 (Carboxymethyl)dimethyloctadecylammonium hydroxide
D-8 (Carboxymethyl)dimethylundecylcaramoylpropylammonium hydroxide
D-9 (3-Sulfobutyl)dimethylundecylcarbamoylpropylammonium hydroxide
D-10 (10-Carboxydecyl)pyridinium hydroxide
D-11 1-(10-Sulfatedecyl)pyridinium hydroxide
D-12 3-(Carboxy-1-dodecylpyridinium hydroxide
D-13 1-(1-Carboxytridecyl)pyridinium hydroxide In this invention, in addition to the above-described anionic surface active agent and amphoteric surface active agent, a nonionic surface active agent such as saponin (steroid series), a polyalkylene glycol alkylamine, a polyalkylene glycol alkylamide, a polyethylene oxide addition product of silicone, a glycidol derivative (e.g., alkenylsuccinic acid polyglyceride, alkenylphenol polyglyceride, etc.), an aliphatic acid ester of a polyhydric alcohol, an alkyl ester of sugar, an alkyl urethane of sugar, an alkyl esther of urethane, etc.; or a cationic surface active agent such as an alkylamine salt, an aliphatic or aromatic quaternary ammonium salt, a heterocyclic quaternary ammonium salt (e.g., pyridinium, imidazolium, etc.), an aliphatic ring- or heterocyclic ring-containing phosphonium or sulfonium salt may be used together.

In the case of using a polyalkylene oxide in this invention, it is preferred to use the polyalkylene oxides having a molecular weight of more than 600 described in Japanese patent publication No. 9412/83.

As the binder or protective colloid for the silver halide emulsion for use in this invention, gelatin is advantageously used but other hydrophilic colloids can be used. For example, there are proteins such as gelatin derivatives, graft polymers of gelatin and other polymers, albumin, casein, etc.; cellulose derivatives such as hydroxyethyl cellulose, carboxymethyl cellulose, cellulose sulfuric acid ester, etc.; sugar derivatives such as sodium alginate, starch derivatives, etc.; and various synthetic hydrophilic polymers such as polyvinyl alcohol, polyvinyl alcohol partial acetal, poly-N-vinylpyrrolidone, polyacrylic acid, polymethacrylic acid, polyacrylamide, polyvinyl imidazole, polyvinyl pyrazole, etc.

As gelatin, lime-processed gelatin as well as acid-processed gelatin, hydrolyzed product of gelatin, or enzyme-decomposed product of gelatin may be used.

The silver halide photographic emulsion for use in this invention may contain a dispersion of a water-soluble or water sparingly soluble synthetic polymer can be used for the purpose of improving the dimensional stability of the light-sensitive material. Examples of such polymers are polymers composed of alkyl (meth)-acrylate, alkoxyacryl (meth) acrylate, glycidyl (meth)acrylate, (meth)acrylamide, a vinyl ester (e.g., vinyl acetate), acrylonitrile, olefin, styrene, etc., individually or as a combination of them, or a combination of the aforesaid monomer(s) and a monomer such as acrylic acid, methacrylic acid, $\alpha,\beta$-unsaturated dicarboxylic acid, hydroxyalkyl (meth)acrylate, sulfoalkyl (meth)acrylate, styrenesulfonic acid, etc.

Specific examples of these polymers are described in U.S. Pat. Nos. 2,376,005, 2,739,137, 2,953,457, 3,062,674, 3,411,911, 3,488,708, 3,525,620, 3,607,290, 3,635,715, 3,645,745, British Pat. Nos. 1,186,699, 1,307,373, etc.

For obtaining high contrast photographic images using the above-described silver halide photographic light-sensitive material of this invention, a conventional infection developer or the high alkaline developer having pH 13 described in U.S. Pat. No. 2,419,975 is unnecessary and a stable developer can be used.

That is, for the above-described silver halide photographic light-sensitive material of this invention, a developer sufficiently containing a sulfite ion (in particular, higher than 0.15 mol/liter) as a preservative can be used and also sufficiently high contrast negative images can be obtained by using a developer having pH of higher than 9.5, in particular of 10.5 to 12.3.

There is no particular restriction on the developing agent which is used for processing silver halide light-sensitive material of this invention and, for example, dihydroxybenzenes (e.g., hydroquinone, etc.), 3-pyrazolidones (e.g., 1-phenyl-3-pyrazolidone, 4,4-dimethyl-1-phenyl-3-pyrazolidone, etc.), aminophenols (e.g., N-methyl-p-aminophenol, etc.), etc., can be used solely or as a combination of them.

The developer for use in this invention may further contain a pH buffer such as a sulfite, carbonate, borate, or phosphate of an alkali metal and a development inhibitor or an antifoggant such as a bromide, an iodide, or an organic antifoggant (particularly preferably a nitroindazole and a benzotriazole). Also, if necessary, the developer may further contain a water softener, a dissolution aid, a toning agent, a development accelerator, a surface active agent (in particular, the above-described polyalkylene oxide), a defoaming agent, a hardening agent, a silver staining preventing agent of film (e.g., a 2-mercaptobenzimidazolesulfonic acid), etc.

Specific examples of these additives are described in *Research Disclosure*, No. 176 (17643), etc.

The processing temperature is usually selected in the range of 18° C. to 50° C. but may be lower than 18° C. or higher than 50° C.

The silver halide photographic material of this invention is usually fixed after development and for the purpose a fix solution having an ordinary component can be used. As the fixing agent for the fix solution, there are a thiosulfate, thiocyanate, and organic sulfur compounds which are known to have an effect as a fixing agent. Also, the fix solution may further contain a water-soluble aluminum salt as a hardening agent.

For processing the silver halide photographic material of this invention, an automatic processor is preferably used.

The invention is further explained in detail by referring to the non-limiting following examples.

EXAMPLE 1

Two kinds of silver halide emulsions A and B were prepared by the following manner using solution I and solution II below.

Solution I: 300 ml of water and 9 g of gelatin

Solution II: 100 g of $AgNO_3$ and 400 ml of water (1) Silver Halide Emulsion A (5 mol % Br):

Solution IIIA: 3.5 g of KBr, 35 g of NaCl, and 400 ml of water

To solution I maintained at 45° C. were simultaneously added solution II and solution IIIA at a constant speed to form a silver halide emulsion. After removing soluble salts from the emulsion by a conventional manner, gelatin was added to the emulsion and then 6-methyl-4-hydroxy-1,3,3a, 7-tetraazaindene was added thereto as a stabilizer. The mean grain size of the silver halide emulsion thus formed was 0.20 μm and the amount of gelatin contained in 1 kg of the emulsion was 60 g.

(2) Silver Halide Emulsion B (5 mol % Br, Rh: $2\times10^{-5}$ mol/mol silver):

Solution IIIB: 3.5 g of KBr, 35 g of NaCl, 4 mg of $NH_4RhCl_6$, and 400 ml of water Silver halide emulsion B was prepared by the same manner as the case of preparing silver halide emulsion A using solution IIIB in place of solution IIIA.

To each of the silver halide emulsion were added Hydrazide Derivative XI-21 and Dye F-16 of this invention in the amounts shown in Table I below and after adding thereto a dispersion of polyethyl acrylate and 2-hydroxy-4,6-dichloro-1,3,5-triazine sodium salt, the resulting mixture was coated on a polyethylene terephthalate at a silver coverage of 3.5 g/m².

Then a coating composition for protective layer was prepared by adding gelatin, Surface Active Agents C-2 and D-8, Mordant G (the compound included in general formula (II)), and Dye F-16 to water and the coating composition was coated on the above-described silver halide emulsion layer at a coverage of dye shown in Table I below as a protective layer. In this case, when the dye was added to the coating composition for the protective layer, the mordant was added thereto at a coverage of 1.0 g/m².

Mordant G:

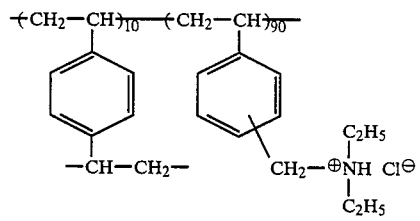

The samples thus prepared each was exposed through an optical wedge by P-607 Type Printer (made by Dainippon Screen Mfg. Co., Ltd.), developed by the developer having the following composition for 20 seconds at 38° C, stopped, fixed, washed and dried. The results obtained are shown in Table 1 below.

| Developer: | |
|---|---|
| Ethylenediaminetetraacetic Acid Tetrasodium Salt | 1.0 g |
| Sodium Hydroxide | 13.0 g |
| Potassium Tertiary Phosphate | 74.0 g |
| Potassium Sulfite | 90.0 g |
| 3-Diethylamino-1-propanol | 15.0 g |
| N—Methyl-p-aminophenol · ½Sulfate | 0.8 g |
| Hydroquinone | 35.0 g |
| 5-Methylbenzotriazole | 0.5 g |
| Sodium Bromide | 3.0 g |
| Water to make | 1 liter (pH = 11.6) |

Note: In Table 1 below, the definition of each term is as follows:

(1) Relative sensitivity: The reciprocal of the light exposure amount giving a density of 1.5, that of sample 3 being defined as 100.

(2) γ: (3.0–0.3)/-[log(A)-log(B)]

(A): Exposure amount giving density of 0.3

(B): Exposure amount giving density of 3.0

(3) Fog after irradiation of safe light: Fog formed in the case of developing the sample after exposing the sample to a fading preventing fluorescent lamp (FLR 40 SW-DL-X NU/M), made by Toshiba Corporation for 1 hour at about 200 luxes.

(4) Letter image quality: A laminate film is formed by laminating an affix base, a film having line positive images (line image original), an affix base, and a film having halftone dot images (halftone dot image original) in this order as described in Japanese patent application (OPI) No. 190943/83. The laminate film is superposed on each of the samples so that the halftone dot image original and the protective layer are in face-to-face relationship, the sample in that state is subjected to a correct exposure that 50% halftone dot area of the halftone dot original is formed on the silver halide emulsion layer of the sample as 50% halftone dot area, and then the sample is processed as described above. In this case, the letter image quality of a sample capable of reproducing the 30 μm width letter of the line image original is defined as rank 5, the letter image quality of a sample capable of reproducing only letters having a width of broader than 150 μm is defined as rank 1, and ranks 4, 3 and 2 are formed between the two ranks by functional evaluation. Rank 2 is a practical usable limit.

TABLE 1

| Sample No. | Emulsion (Rh: mol/mol Ag | Amount of XI-21 (mol/mol Ag) | Dye F-16 (a)*1 (g/m2) | Dye F-16 (b)*2 (g/m2) | (I) | (II) | (III) | (IV) |
|---|---|---|---|---|---|---|---|---|
| 1 | A (—) | $2.5 \times 10^{-4}$ | — | — | 500,000 | 12 | 5.0 | 4 |
| 2 | B ($2 \times 10^{-5}$) | $2.5 \times 10^{-3}$ | — | — | 500 | 15 | 2.0 | 5 |
| 3 | B ($2 \times 10^{-5}$) | $2.5 \times 10^{-3}$ | 0.10 | — | 300 | 10 | 0.6 | 3 |
| 4 | B ($2 \times 10^{-5}$) | $2.5 \times 10^{-3}$ | 0.20 | — | 100 | 5 | 0.25 | 2 |
| 5 | B ($2 \times 10^{-5}$) | $2.5 \times 10^{-3}$ | 0.40 | — | 50 | 2.5 | 0.10 | 1 |
| 6 | B ($2 \times 10^{-5}$) | $2.5 \times 10^{-3}$ | — | 0.06 | 300 | 13 | 0.3 | 5 |
| 7 | B ($2 \times 10^{-5}$) | $2.5 \times 10^{-3}$ | — | 0.13 | 100 | 12 | 0.10 | 4 |
| 8 | B ($2 \times 10^{-5}$) | $2.5 \times 10^{-3}$ | — | 0.25 | 50 | 11 | 0.04 | 3 |

(a)*1: In silver halide emulsion layer;
(b)*2: In protective layer;
(I): Relative sensitivity;
(II): γ;
(III): Fog after irradiation of safe light;
(IV): Letter image quality.
Samples 6 to 8 are samples of this invention.

As is clear from the results of Samples (comparison) 1 and 2 shown in Table 1 above, the sensitivity of a light-sensitive material is reduced to $1/10^3$ by the addition of a rhodium salt in the silver halide emulsion layer thereof but the formation of fog after irradiation of safe light is still high.

On the other hand, Samples (comparison) 3,4 and 5 containing the dye in each silver halide emulsion layer shown improved safe light safety as compared to Sample 2 but show reduction in β and also great reduction in letter image quality to an extent unsuitable for practical use. It can be seen, on the other hand, that Samples 6 to 8 of this invention scarcely show the reduction in β and improved safe light safety.

EXAMPLE 2

Samples 9 to 13 were prepared by following the same procedure as the case of preparing Sample 7 of this invention in Example 1 except that each of Compounds A-1, A-2, B-1 and B-7 for use in this invention was added to the silver halide emulsion layer and each of the samples was exposed and developed as in Example 1.

The results thus obtained are shown in Table 2 below.

TABLE 2

| Sample No. | Emulsion (Rh: mol/mol Ag) | Amount of XI-21 (mol/mol Ag) | Compound of this invention Kind | Compound of this invention Amount (mol/mol Ag) | Amount of Dye F-16 in Emulsion (g/m2) | (I) | (II) | (III) |
|---|---|---|---|---|---|---|---|---|
| 7 | B ($2 \times 10^{-5}$) | $2.5 \times 10^{-3}$ | — | — | 0.13 | 100 | 12 | 0.10 |
| 9 (Invention) | " | " | A-1 | $5 \times 10^{-4}$ | " | 115 | 17 | 0.11 |
| 10 (Invention) | " | " | A-2 | " | " | 110 | 15 | 0.10 |
| 11 (Invention) | " | " | B-1 | $3 \times 10^{-4}$ | " | 120 | 20 | 0.11 |
| 12 (Invention) | " | " | B-7 | " | " | 110 | 16 | 0.10 |
| 13 (Invention) | " | " | A-1<br>B-1 | $5 \times 10^{-4}$<br>$3 \times 10^{-4}$ | " | 125 | 25 | 0.12 |

(I): Relative sensitivity;
(II): γ;
(III): Fog after irradiation of safe light

From the results shown in Table 2 above, it can be seen that when the phosphonium salt compound as A-1 and A-2 or the disulfide compound as B-1 and B-7 is added to the silver halide emulsion layers, the sensitivity and γ can be increased without reducing the safe light safety of the light-sensitive materials. Also, in Sample 13 containing both the phosphonium salt compound and the disulfide compound, the same results as above are obtained.

EXAMPLE 3

By forming silver halide grains in the presence of rhodium ammonium chloride, a silver chlorobromide emulsion (containing 5 mol % bromine) containing a rhodium salt in an amount of $2.0 \times 10^{-5}$ mol per mol of silver was prepared. The mean grain size thereof was 0.20 μm. After washing the emulsion by a conventional manner to remove soluble salts, 4-hydroxy-6-methyl-1,3,3a, 7-tetraazaindene was added to the emulsion as a stabilizer.

The silver halide emulsion thus obtained was split into 10 portions. To each of them was added Hydrazine Derivative XI-21 of this invention in an amount of $2.5 \times 10^{-3}$ mol per mol of silver and after adding thereto a dispersion of polyethyl acrylate and 2-hydroxy-4,6-dichloro-1,3,5-triazine. sodium salt, the resulting mixture was coated on a polyethylene terephthalate film at a silver coverage of 3.5 g/m2.

On each of 10 silver halide emulsion layers thus formed was coated an aqueous gelatin solution containing or not containing the dye shown in Table 3 at a gelatin coverage of 1.0 g/m$^2$.

Each of the samples thus obtained was exposed and developed as in Example 1. The results thus obtained are shown in Table 3.

TABLE 3

| Sample No. | Dye (Compound No.) | λmax (in $H_2O$) (nm) | Coated Amount (g/m$^2$) | (I) | (II) | (IV) | (III) | Residual Color* |
|---|---|---|---|---|---|---|---|---|
| 14 | — | — | — | 100 | 15 | 5 | 2.00 | 0.00 |
| 15 | E-4 | 422 | 0.27 | 30 | 12 | 4 | 0.01 | 0.01 |
| 16 | E-5 | 420 | " | 30 | 12 | 4 | 0.02 | 0.01 |
| 17 | E-9 | 428 | " | 45 | 13 | 5 | 0.02 | 0.01 |
| 18 | E-12 | 432 | " | 50 | 14 | 5 | 0.03 | 0.01 |
| 19 | E-22 | 434 | " | 45 | 15 | 5 | 0.01 | 0.01 |
| 20 | E-28 | 420 | " | 40 | 12 | 4 | 0.03 | 0.01 |

(a): In protective layer;
(I): Relative sensitivity;
(II): γ;
(IV): Letter image quality;
(III): Fog after irradiation of safe light
*Residual color: Absorption coefficient of λmax after development From the results shown in Table 3 above, it can be seen that in Samples 15 to 20 of this invention, the dye added to the protective layer hardly diffuses to the emulsion layer, the safe light safety of the light-sensitive materials can be remarkably increased without substantially reducing γ and letter image quality, and the residual color after processing hardly occur.

EXAMPLE 4

A silver chlorobromide emulsion (containing 5 mol % silver bromide) was prepared in the presence of α-$NH_4RhCl_6$ in an amount of $1.9\times10^{-5}$ mol per mol of silver halide and then 4-hydroxy-6-methyl-1,3,3a, 7-tetraazaindene was added thereto as a stabilizer.

The silver halide emulsion thus obtained was split into four portions. To each of the emulsions was added Hydrazine Derivative XI-21 in amount of $2.5\times10^{-3}$ mol per mol of silver and after adding thereto 2-hydroxy-4,6-dichloro-1,3,5-triazine sodium salt as a hardening agent, the resulting mixture was coated on a polyethylene terephthalate film at a silver coverage of 4.0 g/m$^2$.

On each of the emulsion layers thus formed was coated on a protective layer by the following manner to provide each sample.

Sample 23: Gelatin and Surface Active Agents C-9 and D-8 were added to water and the mixture was coated on the emulsion layer as a protective layer.

Sample 24: Gelatin, Surface Active Agents C-9 and D-8, and a dye, Tartrazine shown below were added to water and the mixture was coated as a protective layer.

Sample 25: Gelatin, Surface Active Agents A-9 and B-8, the dye, Tartrazine, and Mordant H shown below were added to water and the mixture thus obtained was coated as a protective layer (at 0.5 g/m$^2$ of dye coverage and 1.0 g/m$^2$ of mordant coverage)

Mordant H:

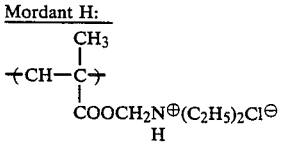

-continued

Tartrazine:

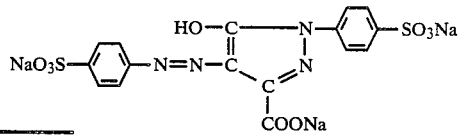

Sample 26: In the case of coating the protective layer in Sample 25, a solution of gelatin, surface active agents and water was coated between the emulsion layer and the protective layer as an interlayer at a dry thickness of 0.5 micron.

Each of the samples thus obtained was exposed and developed as in Example 1 and the results obtained are shown in Table 4, in which (1) relative sensitivity, (2) γ and (3) fog after safe light irradiation were evaluated in the same manner as in Example 1.

(4) Adhesivity: Fifty squares of 1 cm×1 cm were formed on the coated surface of each sample and when a polyester adhesive tape made by Nitto Electric Industrial Co., Ltd. was struck to the surface of the coating and peeled off, the area of the coated layer thus peeled off was measured, whereby the adhesivity of the coated layer was evaluated.

TABLE 4

| Sample No. | Protective Layer Dye | Protective Layer Mordant | (a) | (I) | (II) | (III) | (V) (%) |
|---|---|---|---|---|---|---|---|
| 23 | None | None | — | 219 | 13 | 0.29 | 0 |
| 24 | Used | None | — | 123 | 8 | 0.09 | 0 |
| 25 | Used | Used | — | 100 | 11 | 0.06 | 82 |
| 26 | Used | Used | Formed | 95 | 12 | 0.06 | 0 |

(a): Interlayer
(I), (II) and (III): Same as in Table 1
(V): Adhesivity (peeled area)

As shown in Table 4, it can be seen that in the sample of this invention wherein the dye is added to the protective layer together with the mordant and the interlayer is formed between the protective layer and the emulsion layer, the safe light property is improved without lowering the contrast by the addition of the dye and also the sample shows excellent adhesion.

EXAMPLE 5

A silver iodobromide emulsion (containing 1.7 mol % iodine) was prepared by forming silver halide grains by a double jet method, physically ripening the silver halide emulsion thus formed, and after desalting, further chemically ripening the emulsion. The mean grain size of the silver halide grains contained in the silver halide emulsion was 0.32 micron and the emulsion contained 0.86 mol of silver halide in 1 kg of the emulsion.

After fusing 1 kg of the silver halide emulsion at 40° C., 3-ethyl-5-(3'-carboxymethylthiazolinethylidene)-rhodanine was added to the emulsion and after further adding thereto 4-hydroxy-6-methyl-1,3,3a, 7-tetraazaindene, the mixture was stirred. Then, 1-hydroxy-3,5-dichlorotriazine sodium salt was added thereto to provide the desired silver halide emulsion. The silver halide emulsion thus obtained was coated on a cellulose triacetate film base at a dry thickness of 5 microns.

Gelatin, the dye (Dye F-12) shown before and Mordant H (the compound included in general formula (I)) shown below were added to water and the mixture was coated on the silver halide emulsion layer formed in the above step at the coverage of dye shown in Table 5 below as a hydrophilic colloid layer.

Furthermore, another hydrophilic colloid layer was formed on the aforesaid dye-containing hydrophilic colloid layer. The uppermost hydrophilic colloid layer contained the compound(s) shown in Table 5 as surface active agent(s) and gelatin.

The coating property of each sample thus obtained was as follows.

TABLE 5

| Sample No. | Amount of Dye F-12 ($g/m^2$) | Surface Active Agent | Result |
|---|---|---|---|
| 27 | 0.1 | None | Coating property very bad |
| 28 | 0.1 | D-8 (uppermost) layer) 0.1 $g/m^2$ | Coating property bad |
| 29 | 0.1 | C-12 (uppermost layer) 0.1 $g/m^2$ | Coating property good, mordanting property slightly reduced |
| 30 | 0.1 | D-8 (uppermost layer) 0.05 $g/m^2$<br>C-12 (uppermost layer) 0.05 $g/m^2$ | Coating property good, mordanting property good |
| 31 | 0.1 | C-12 0.1 $g/m^2$* | Coating property good, mordanting property bad |
| 32 | 0.1 | D-8 0.05 $g/m^2$*<br>D-12 0.05 $g/m^2$* | Coating property good, mordanting property slightly reduced |

*The uppermost layer was not formed and the surface active agent(s) were incorporated in the hydrophilic colloid layer containing the dye.

Mordant H:

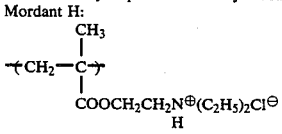

EXAMPLE 6

A silver halide emulsion was prepared in the same manner as in Example 5.

The mean grain size of the silver halide was 0.28 μm and the emulsion was a silver chlorobromide emulsion containing 27 mol % Br.

The silver halide emulsion was chemically sensitized by the addition of sodium thiosulfate and potassium chloroaurate and then spectrally sensitized by the addition of 3-ethyl-5-(3'-carboxymethylthiazolinidene) rhodanine. Furthermore, after adding thereto 4-hydroxy-6-methyl-1,3,3a, 7-tetraazaindene, Hydrazine compound XI-21 in an amount of $2.5\times10^{-4}$ per mol of silver, and 2-hydroxy-4,6-dichloro-1,3,5-triazine sodium salt, the resulting mixture was coated on a cellulose triacetate film at a silver coverage of 3.8 $g/m^2$.

On the silver halide emulsion layer was coated the following hydrophilic colloid layer.

Sample 33: Gelatin and Surface Active Agents C-9 and D-8 were added to water and the mixture was coated on the protective layer at a gelatin coverage of 1 $g/m^2$ and each surface active agent coverage of 0.05 $g/m^2$.

Sample 34: Gelatin, Surface Active Agents C-9 and D-8, and Dye F-2 were added to water and the mixture was coated at the protective layer at a gelatin coverage of 1 $g/m^2$ and each surface active agent coverage of 0.05 $g/m^2$.

Sample 35: Gelatin, Surface Active Agents C-9 and D-8, Dye F-12, and Mordant G shown below were added to water and the mixture was coated as the protective layer at a gelatin coverage of 1 $g/m^2$, each surface active agent coverage of 0.05 $g/m^2$, a dye coverage of 0.1 $g/m^2$ and a mordant coverage of 0.3 $g/m^2$.

Mordant G:

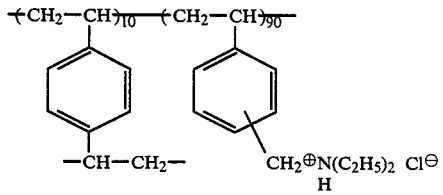

Sample 36: Gelatin, Dye F-12, and Mordant G described above were added to water and the mixture was coated on the emulsion layer at a gelatin coverage of 1 $g/m^2$, a dye coverage of 0.1 $g/m^2$ and a mordant coverage of 0.3 $g/m^2$. In this case, an aqueous solution of gelatin and Surface Active Agents C-9 and D-8 was further coated thereon as a protective layer at each surface active agent coverage of 0.05 $g/m^2$.

Each of Samples 33 to 36 thus prepared was white-exposed and developed using Developer GS-1, made by Fuji Photo Film Co., Ltd, by means of an automatic processor (FG-660F). The results thus obtained are shown in Table 6 below.

TABLE 6

| Sample No. | Directly after Coating: Relative Sensitivity | Fog | γ | Fog after Safe Light Irradiation* | Coating Property |
|---|---|---|---|---|---|
| 33 | 178 | 0.04 | 12.5 | 0.37 | Good |
| 34 | 117 | 0.06 | 7.8 | 0.09 | Good |
| 35 | 100 (standard) | 0.06 | 11.7 | 0.06 | Good |
| 36 | 98 | 0.04 | 12.9 | 0.04 | Good |

*Fog after safe light irradiation: Fog in the case of developing the sample after exposing the sample to a 40 W white lamp through a filter SC-52, made by Fuji Photo Film Co., Ltd. and a paraffin paper at a distance of 50 cm for 10 minutes.

From the results shown in Table 6, it can be seen that in sample 36 of this invention, the formation of fog is less, γ is high, and the coating property is good.

EXAMPLE 7

A silver halide emulsion composed of 96 mol % silver chloride containing $1\times10^{-5}$ mol Rh per mol of silver and 4 mol % silver bromide (mean grain size: 0.23 μm). To the silver halide emulsion was added Compound XI-21 in an amount of $2.5\times10^{-4}$ mol per mol of silver and after adding thereto 2-hydroxy-4,6-dichloro-1,3,5-triazine sodium salt as a hardening agent and potassium polystryenesulfonate as a thickener, the resulting mixture was coated on a polyethylene terephthalate film at a silver coverage of 3.8 g/m². On the silver halide emulsion layer was coated an aqueous gelatin solution containing Dye F-9 and Mordant G shown in Table 7 below in an amount shown in the table as a protective layer. In this case, Surface Active Agents C-9 and D-8 were used as coating aids.

Each of the samples thus obtained was processed as in Example 1. The results thus obtained are shown in Table 7 below.

(Note): In Table 7 below, (1) relative sensitivity, (2) γ, and (3) fog after safe light irradiation were evaluated as in Example 1.

(4) Wet scratching strength: Load capable of forming scratches when the sample surface is scratched by a steel needle of 0.8 mm in diameter in the developer having the same composition as in Example 1 at 38° C.

TABLE 7

| Sample No. | Gelatin Kind | Gelatin Isoelectric Point | Gelatin Coated Amount (g/m²) | Mordant G (g/m²) | Dye F-9 (g/m²) | (I) | (II) | (III) | (IV) |
|---|---|---|---|---|---|---|---|---|---|
| 37 | Alkali-processed | 4.8 | 1.0 | — | — | 355 | 15 | 2.0 | 160 |
| 38 | " | 4.8 | 1.0 | — | 0.25 | 100 | 5 | 0.22 | 159 |
| 39 | " | 4.8 | 0.8 | 0.8 | 0.25 | 95 | 11 | 0.03 | 68 |
| 40 | Acid-processed | 9.0 | 1.0 | — | 0.25 | 95 | 11 | 0.03 | 160 |
| 41 | " | 7.6 | 1.0 | 0.2 | 0.25 | 98 | 11 | 0.04 | 155 |
| 42 | " | 7.6 | 1.0 | 0.4 | 0.25 | 95 | 11 | 0.03 | 150 |
| 43 | Acid-processed | 9.0 | 0.5 | — | 0.25 | 98 | 10 | 0.04 | 161 |
| | Alkali-processed | 4.8 | 0.5 | | | | | | |

(I): Relative sensitivity;
(II): γ;
(III): Fog after irradiation of safe light;
(IV): Letter image quality Mordant G:

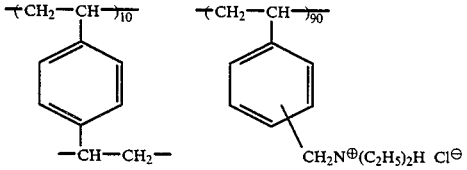

As is clear from the results shown in Table 7, it can be seen that in Samples 40 to 43 using acid-processed gelatin, γ is high, a safe light property is good, and the film strength in the developer is high.

While the invention has been described in detail and with reference to specific embodiments thereof, it will be apparent to one skilled in the art that various changes and modifications can be made therein without departing from the spirit and scope thereof.

What is claimed is:

1. A high contrast silver halide photographic material capable of producing an image having a contrast of higher than 10 in gamma rendered safe for development under a safe light comprising a support having formed thereon at least one silver halide emulsion layer and at least one light-insensitive hydrophilic colloid layer, wherein at least one of the layers consisting of at least one silver halide emulsion layer and said at least one light-insensitive hydrophilic colloid layer contains from $1\times10^{-6}$ mol to $5\times10^{-2}$ mol per mol of silver halide of hydrazine derivative selected from the group consisting of aryl hydrazines wherein a sulfinic acid residue is bonded to a hydrazo moiety and hydrazine derivatives of formula (XI)

$$R_{51}\text{-NHNH-G-}R_{52} \qquad \text{(XI)}$$

wherein $R_{51}$ represents an aliphatic or aromatic group, $R_{52}$ represents a hydrogen atom, a substituted or unsubstituted alkyl group, a substituted or unsubstituted aryl group, a substituted or unsubstituted alkoxy group, or a substituted or unsubstituted aryloxy group; and G represents a carbonyl group, a sulfonyl group a sulfoxy group, a phosphoryl group, or an N-substituted or unsubstituted imino group, and wherein at least one of said at least one light-insensitive hydrophilic colloid layer formed on the uppermost silver halide emulsion layer, but not said light sensitive silver halide emulsion layer, contains a dye having an absorption covering the wavelength region of the safe light n an amount of from $10^{-3}$ g/m² to 1 g/m², said dye being selected from the group represented by the formula (a), (b), (c), (d), (e) and (f):

(a)

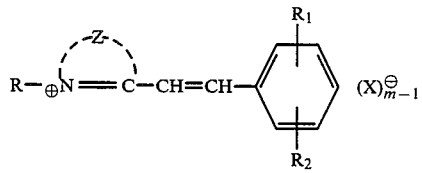

(b)

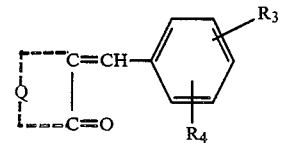

(c)

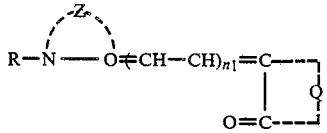

-continued (d)

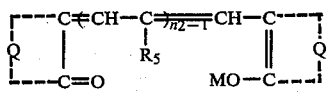

wherein Z represents a non-metallic atomic group necessary for forming heterocyclic nuclei of benzothiazole, naphthothiazole, or benzoxazole; Q represents an atomic group necessary for forming pyrazolone, barbituric acid, thiobarbituric acid, isoxazolon, 3-oxythionaphthene, or 1,3-indanedione; R represents a substituted or unsubstituted alkyl group; $R_1$, $R_2$, $R_3$ and $R_4$ each represents a hydrogen atom, an alkoxy group, a dialkylamino group or a sulfo group; $R_5$ represents a hydrogen atom or a halogen atom; M represents a hydrogen atom, a sodium atom; X represents an anion; m, $n_1$ and $N_2$ each represents 1 or 2 when m is 1, the dye forms an intramolecular salt;

(e)

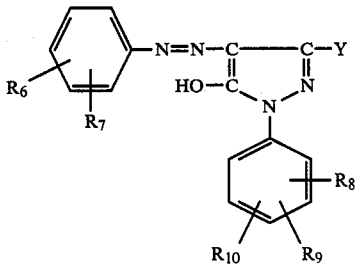

(f)

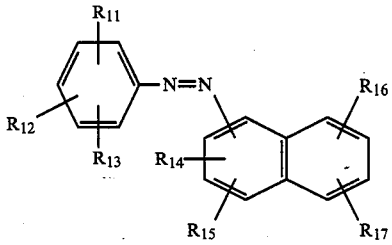

wherein Y represents an alkyl group or a carboxy group; $R_6$, $R_7$, $R_8$, $R_9$, $R_{10}$, $R_{11}$, $R_{12}$, $R_{13}$, $R_{14}$, $R_{15}$, $R_{16}$ and $R_{17}$ each represents a hydrogen atom, an alkyl group, a hydroxy group, an amino group, an acylamino group, a carboxy group or a sulfo group; said $R_{12}$ and $R_{13}$ may combine with each other to form a benzene ring.

2. The silver halide photographic material as claimed in claim 1, wherein an interlayer is formed between said silver halide emulsion layer and said light-insensitive hydrophilic colloid layer.

3. The silver halide photographic material is claimed in claim 1, wherein said dye is employed in an amount of from $10^{-3}$ g/m$^2$ to 0.5 g/m$^2$.

4. The silver halide photographic material as claimed in claim 1, wherein said hydrophilic colloid layer additionally contains a polymer mordant.

5. The silver halide photographic material as claim in claim 4, wherein said polymer mordant is a polymer selected form the group consisting of a polymer having a secondary or tertiary amino group, a polymer having a nitrogen-containing heterocyclic ring moiety, and a polymer having a quaternary cation group, where said polymer has a molecular weight of from 5,000 to 200,000.

6. The silver halide photographic material as claimed in claim 4, wherein said polymer mordant is employed in an amount of from 0.5 to 8 g/m$^2$.

7. The silver halide photographic material as claimed in claim 1, wherein said hydrazine derivative is employed in an amount of from $1\times10^{-6}$ mol to $5\times10^{-2}$ mol per mol of silver.

8. The silver halide photographic material as claimed in claim 7, wherein said hydrazine derivative is employed in an mount of from $1\times10^{-5}$ mol to $2\times10^{-2}$ mol per mol of silver.

9. The silver halide photographic material as claimed in claim 1, wherein said light-insensitive hydrophilic colloid layer containing the dye contains gelatin having an isoelectric point of higher than 5.5.

10. The silver halide photographic material as claimed n claim 1, wherein said dye is selected from the group consisting of a dye capable or reducing the light sensitivity of the silver halide emulsion for visible rays.

11. The silver halide photographic material as claimed in claim 10, wherein the dye is a dye having ma in the rang of 390 nm to 750 nm.

12. The silver halide photographic material as claimed in claim 1, wherein at least two light-insensitive hydrophilic colloid layers are formed on the uppermost silver halide emulsion layer, said at least two light-insensitive hydrophilic colloid layers containing an anionic surface active agent and an amphoteric surface active agent and at least one of said at least two light-insensitive hydrophilic colloid layers other than an uppermost light-insensitive hydrophilic colloid layer containing the dye.

13. The silver halide photographic material as claimed in claim 1, wherein said light-insensitive hydrophilic colloid layer containing the dye contains a mordant.

14. The silver halide photographic material as claimed in claim 13, wherein said light-insensitive hydrophilic colloid layer containing the dye and the mordant contains an anionic surface active agent and an

15. A silver halide photographic material as in claim 1, capable of providing a high contrast image having a gamma of over 10 upon imagewise exposure followed by development.

16. A silver halide photographic material as in claim 1 containing a compound represented by formula (XI)

$$R_{51}\text{-NHNH-G-}R_{52} \qquad \text{(XI)}$$

wherein $R_{51}$ represents an aliphatic group having from 1 to 30 carbon atoms selected from a straight chain, a branched chain, or a cyclic alkyl group, said alkyl group being unsubstituted or substituted with an aryl group, an alkoxy group, a sulfoxy group, a sulfonamido group, or a carbonamido group, or a monocyclic or bicyclic aromatic group or an unsaturated heterocyclic group, said aromatic or unsaturated heterocyclic groups being unsubstituted or substituted with a straight chain, branched or cyclic alkyl group an aralkyl group, an alkoxy group, a substituted amino group, an acylamino group, a sulfonamido group, or a ureido group; and wherein $R_{52}$ represents an unsubstituted or substituted alkyl group having 1 4 carbon atoms, said substituent being selected from the group consisting of a halogen atom, a cyano group, a carboxy group, a sulfo group, an alkoxy group, and a phenyl group, a substituted or unsubstituted monocyclic or bicyclic aryl group, said substituent being selected from the group consisting of a halogen atom, an alkyl group, a cyano group, a carboxy group and a sulfo group, a substituted or unsubstituted alkoxy group having 1 to 8 carbon atoms, said substituent being selected from the group consisting of a halogen atom and an aryl group, or a substituted or unsubstituted monocyclic aryloxy group wherein the substituent may be a halogen atom.

* * * * *